US009200483B2

(12) United States Patent
Gavia et al.

(10) Patent No.: US 9,200,483 B2
(45) **Date of Patent: *Dec. 1, 2015**

(54) EARTH-BORING TOOLS AND METHODS OF FORMING SUCH EARTH-BORING TOOLS

(71) Applicant: Baker Hughes Incorporated, Houston, TX (US)

(72) Inventors: David Gavia, The Woodlands, TX (US); Nicholas J. Lyons, Sugar Land, TX (US); Juan Miguel Bilen, The Woodlands, TX (US); Danny E. Scott, Montgomery, TX (US); Rudolf Carl Pessier, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/506,175

(22) Filed: Oct. 3, 2014

(65) Prior Publication Data

US 2015/0034394 A1 Feb. 5, 2015

Related U.S. Application Data

(63) Continuation of application No. 13/101,840, filed on May 5, 2011, now Pat. No. 8,851,207.

(51) Int. Cl.
*E21B 10/36* (2006.01)
*E21B 10/43* (2006.01)
(Continued)

(52) U.S. Cl.
CPC ..... *E21B 10/43* (2013.01); *E21B 10/55* (2013.01); *E21B 10/5673* (2013.01); *E21B 10/602* (2013.01)

(58) Field of Classification Search
CPC ... E21B 10/55; E21B 10/602; E21B 10/5673; E21B 10/43; E21B 10/16
USPC ..... 175/428, 431
See application file for complete search history.

(56) References Cited

U.S. PATENT DOCUMENTS 3,459,073 A 8/1969 Conover
4,373,593 A 2/1983 Phaal et al.
(Continued)

FOREIGN PATENT DOCUMENTS

CA 2598057 A1 3/2008
CN 2743526 Y 11/2005
(Continued)

OTHER PUBLICATIONS

International Search Report for International Application No. PCT/US2012/034444 dated Nov. 9, 2012, 10 pages.
(Continued)

*Primary Examiner* — Kenneth L Thompson
*Assistant Examiner* — Michael Wills, III
(74) *Attorney, Agent, or Firm* — TraskBritt

(57) ABSTRACT

Earth-boring drill bits may include a bit body including blades extending radially over a face of the earth-boring drill bit and cutting elements attached to each blade. Only cutting elements including planar cutting faces may be attached to at least one of the blades. Only cutting elements including nonplanar cutting faces may be attached to at least another of the blades. Only cutting elements including planar cutting faces or only cutting elements including nonplanar cutting faces may be attached to each of the blades. Only cutting elements including nonplanar cutting faces may be attached to a number of the blades that may be unequal to a number of the blades to which only cutting elements comprising planar cutting faces may be attached.

20 Claims, 17 Drawing Sheets

(51) Int. Cl.

| | |
|---|---|
| ***E21B 10/55*** | (2006.01) |
| ***E21B 10/60*** | (2006.01) |
| ***E21B 10/567*** | (2006.01) |

(56) References Cited

U.S. PATENT DOCUMENTS

| | | | |
|---|---|---|---|
| 4,440,247 | A | 4/1984 | Sartor |
| 4,471,845 | A | 9/1984 | Jurgens |
| 4,499,958 | A | 2/1985 | Radtke et al. |
| 4,602,691 | A | 7/1986 | Weaver |
| 4,705,124 | A | 11/1987 | Abrahamson et al. |
| 4,718,505 | A | 1/1988 | Fuller |
| 4,722,405 | A | 2/1988 | Langford, Jr. |
| 4,823,892 | A | 4/1989 | Fuller |
| 4,869,330 | A | 9/1989 | Tibbitts |
| 4,889,017 | A | 12/1989 | Fuller et al. |
| 4,942,933 | A | 7/1990 | Barr et al. |
| 4,981,184 | A | 1/1991 | Knowlton et al. |
| RE33,757 | E | 12/1991 | Weaver |
| 5,172,777 | A | 12/1992 | Siracki |
| 5,172,779 | A | 12/1992 | Siracki et al. |
| 5,186,268 | A | 2/1993 | Clegg |
| 5,244,039 | A | 9/1993 | Newton |
| 5,303,785 | A | 4/1994 | Duke |
| 5,322,138 | A | 6/1994 | Siracki |
| 5,379,853 | A | 1/1995 | Lockwood et al. |
| 5,415,244 | A | 5/1995 | Portwood |
| 5,487,436 | A | 1/1996 | Griffin |
| 5,505,273 | A | 4/1996 | Azar |
| 5,531,281 | A | 7/1996 | Murdock |
| 5,549,171 | A | 8/1996 | Mensa-Wilmot et al. |
| 5,558,170 | A | 9/1996 | Thigpen et al. |
| 5,595,252 | A | 1/1997 | O'Hanlon |
| 5,607,024 | A | 3/1997 | Keith |
| 5,649,604 | A | 7/1997 | Fuller |
| 5,697,462 | A | 12/1997 | Grimes et al. |
| 5,706,906 | A | 1/1998 | Jurewicz et al. |
| 5,720,357 | A | 2/1998 | Fuller et al. |
| 5,813,485 | A | 9/1998 | Portwood |
| 5,871,060 | A | 2/1999 | Jensen et al. |
| 5,881,828 | A | 3/1999 | Fischer et al. |
| 5,890,552 | A | 4/1999 | Scott et al. |
| 5,904,213 | A | 5/1999 | Caraway et al. |
| 5,957,227 | A | 9/1999 | Besson et al. |
| 5,967,246 | A | 10/1999 | Caraway et al. |
| 5,992,547 | A | 11/1999 | Caraway et al. |
| 6,000,483 | A | 12/1999 | Jurewicz et al. |
| 6,053,263 | A | 4/2000 | Meiners |
| 6,059,054 | A | 5/2000 | Portwood et al. |
| 6,089,336 | A | 7/2000 | Nexton et al. |
| 6,092,613 | A | 7/2000 | Caraway et al. |
| 6,098,730 | A | 8/2000 | Scott et al. |
| 6,105,694 | A | 8/2000 | Scott |
| 6,129,161 | A | 10/2000 | Roberts et al. |
| 6,142,250 | A | 11/2000 | Griffin et al. |
| 6,176,333 | B1 | 1/2001 | Doster |
| 6,202,770 | B1 | 3/2001 | Jurewicz et al. |
| 6,209,420 | B1 | 4/2001 | Butcher et al. |
| 6,227,318 | B1 | 5/2001 | Siracki |
| 6,241,035 | B1 | 6/2001 | Portwood |
| 6,302,224 | B1 | 10/2001 | Sherwood, Jr. |
| 6,328,117 | B1 | 12/2001 | Berzas et al. |
| 6,332,503 | B1 | 12/2001 | Pessier et al. |
| 6,401,844 | B1 | 6/2002 | Doster et al. |
| 6,408,958 | B1 | 6/2002 | Isbell et al. |
| 6,571,891 | B1 | 6/2003 | Smith et al. |
| 6,601,662 | B2 | 8/2003 | Matthias et al. |
| 6,612,383 | B2 | 9/2003 | Desai et al. |
| 6,615,934 | B2 | 9/2003 | Mensa-Wilmot |
| 6,739,417 | B2 | 5/2004 | Smith et al. |
| 6,997,273 | B2 | 2/2006 | Singh |
| 7,011,169 | B2 | 3/2006 | Eason |
| 7,025,156 | B1 | 4/2006 | Caraway |
| 7,152,703 | B2 | 12/2006 | Meiners et al. |
| 7,216,565 | B2 | 5/2007 | Sherwood, Jr. et al. |
| 7,546,888 | B2 | 6/2009 | Cruz |
| 7,588,102 | B2 | 9/2009 | Hall et al. |
| 7,594,554 | B2 | 9/2009 | Schwefe et al. |
| 7,628,233 | B1 | 12/2009 | Hall et al. |
| 7,641,002 | B2 | 1/2010 | Hall et al. |
| 7,690,442 | B2 | 4/2010 | Portwood et al. |
| 7,798,257 | B2 | 9/2010 | Shen et al. |
| 7,836,978 | B2 | 11/2010 | Scott |
| 8,016,059 | B2 | 9/2011 | Gatell |
| 8,028,774 | B2 | 10/2011 | Hall et al. |
| 8,061,457 | B2 | 11/2011 | Hall et al. |
| 8,205,692 | B2 | 6/2012 | Mcdonough et al. |
| 8,505,634 | B2 | 8/2013 | Lyons et al. |
| 8,534,767 | B2 | 9/2013 | Hall et al. |
| 8,567,532 | B2 | 10/2013 | Hall et al. |
| 8,616,305 | B2 | 12/2013 | Hall et al. |
| 8,714,285 | B2 | 5/2014 | Hall et al. |
| 2003/0034180 | A1 | 2/2003 | Mensa-Wilmot |
| 2004/0094334 | A1 | 5/2004 | Singh |
| 2004/0149493 | A1 | 8/2004 | McDonough |
| 2004/0184944 | A1 | 9/2004 | Geving et al. |
| 2004/0231894 | A1 | 11/2004 | Dvorachek |
| 2005/0023043 | A1 | 2/2005 | Tufts |
| 2006/0131075 | A1 | 6/2006 | Cruz |
| 2006/0249309 | A1 | 11/2006 | Cruz |
| 2007/0039761 | A1 | 2/2007 | Cruz |
| 2007/0106487 | A1 | 5/2007 | Gavia et al. |
| 2007/0199739 | A1 | 8/2007 | Schwefe et al. |
| 2007/0261890 | A1 | 11/2007 | Cisneros |
| 2007/0272445 | A1 | 11/2007 | Cariveau et al. |
| 2008/0029312 | A1 | 2/2008 | Hall et al. |
| 2008/0035380 | A1 | 2/2008 | Hall et al. |
| 2008/0035387 | A1 | 2/2008 | Hall et al. |
| 2008/0099251 | A1 | 5/2008 | Hall et al. |
| 2008/0173482 | A1 | 7/2008 | Hall et al. |
| 2008/0179106 | A1 | 7/2008 | Gavia et al. |
| 2008/0179107 | A1 | 7/2008 | Doster |
| 2008/0179108 | A1 | 7/2008 | McClain et al. |
| 2008/0223622 | A1 | 9/2008 | Duggan et al. |
| 2008/0264695 | A1 | 10/2008 | Zahradnik et al. |
| 2008/0302575 | A1 | 12/2008 | Durairajan et al. |
| 2008/0314647 | A1 | 12/2008 | Hall et al. |
| 2009/0020339 | A1 | 1/2009 | Sherwood, Jr. |
| 2009/0051211 | A1 | 2/2009 | Hall et al. |
| 2009/0055135 | A1 | 2/2009 | Tang et al. |
| 2009/0126998 | A1 | 5/2009 | Zahradnik et al. |
| 2009/0133938 | A1 | 5/2009 | Hall et al. |
| 2009/0145669 | A1 | 6/2009 | Durairajan et al. |
| 2009/0266619 | A1 | 10/2009 | Durairajan et al. |
| 2009/0273224 | A1 | 11/2009 | Hall |
| 2010/0065338 | A1 | 3/2010 | Hall et al. |
| 2010/0065339 | A1 | 3/2010 | Hall et al. |
| 2010/0071964 | A1 | 3/2010 | Hall et al. |
| 2010/0155149 | A1 | 6/2010 | Keshavan et al. |
| 2010/0263939 | A1 | 10/2010 | Hall et al. |
| 2010/0326740 | A1 | 12/2010 | Hall et al. |
| 2011/0042150 | A1 | 2/2011 | Hall et al. |
| 2011/0083906 | A1 | 4/2011 | Hall et al. |
| 2011/0155472 | A1 | 6/2011 | Lyons et al. |
| 2011/0192651 | A1 | 8/2011 | Lyons et al. |
| 2012/0023833 | A1 | 2/2012 | Hall et al. |
| 2012/0031674 | A1 | 2/2012 | Lyons |
| 2012/0125687 | A1 | 5/2012 | Rives |
| 2012/0205163 | A1 | 8/2012 | Azar et al. |
| 2012/0261977 | A1 | 10/2012 | Hall et al. |
| 2012/0279785 | A1 | 11/2012 | Gavia et al. |
| 2013/0199856 | A1 | 8/2013 | Bilen et al. |

FOREIGN PATENT DOCUMENTS

| | | | |
|---|---|---|---|
| EP | 972908 | A2 | 1/2005 |
| GB | 2086451 | A | 5/1982 |

OTHER PUBLICATIONS

International Written Opinion for International Application No. PCT/US2012/034444 dated Nov. 9, 2012, 4 pages.

International Preliminary Report on Patentability for International Application No. PCT/US2012/034444 dated Nov. 5, 2013, 5 pages.

EARTH-BORING TOOLS AND METHODS OF FORMING SUCH EARTH-BORING TOOLS

CROSS-REFERENCE TO RELATED APPLICATIONS

This application is a continuation of U.S. patent application Ser. No. 13/101,840, filed May 5, 2011, now U.S. Pat. No. 8,851,207, issued Oct. 7, 2014, which application's subject matter is related to the subject matter of U.S. patent application Ser. No. 12/793,396, filed Jun. 3, 2010, now U.S. Pat. No. 8,505,634, issued Aug. 13, 2013, to Lyons et al., and U.S. patent application Ser. No. 13/022,288, filed Feb. 7, 2011, now U.S. Pat. No. 8,794,356, issued Aug. 5, 2014, to Lyons et al., the disclosure of each of which is incorporated herein in its entirety by this reference.

FIELD

Embodiments of the disclosure relate generally to earth-boring tools and methods of forming earth-boring tools. Specifically, embodiments of the disclosure relate to earth-boring tools having only shearing cutting elements attached to at least one blade and only gouging cutting elements attached to at least another blade.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit, conventionally in pockets formed in blades and other exterior portions of the bit body. Rolling cone earth-boring drill bits include a plurality of cones attached to bearing pins on legs depending from a bit body. The cones may include cutting elements (sometimes called "teeth") milled or otherwise formed on the cones, which may include hardfacing on the outer surfaces of the cutting elements, or the cones may include cutting elements (sometimes called "inserts") attached to the cones, conventionally in pockets formed in the cones.

The cutting elements used in such earth-boring tools often include polycrystalline diamond cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) comprising a plurality of particles of hard material in a metal matrix, such as, for example, cobalt-cemented tungsten carbide. In such instances, catalyst material in the cutting element substrate may be drawn into the diamond grains or crystals during sintering and catalyze formation of a diamond table from the diamond grains or crystals. In other methods, powdered catalyst material may be mixed with the diamond grains or crystals prior to sintering the grains or crystals together in an HTHP process.

The working surface, sometimes called the cutting face, of cutting elements may have various shapes, such as, for example, planar, hemispherical, conic, and chisel-shaped. Conventionally, cutting elements having a planar working surface may remove an underlying earth formation using a shearing cutting mechanism. By contrast, cutting elements having dome-shaped, conic, and chisel-shaped working surfaces conventionally remove an underlying earth formation using a crushing and gouging cutting mechanism. Furthermore, cutting elements having a plow-shaped working surface conventionally remove an underlying earth formation using a plowing cutting mechanism.

Various earth-boring drill bits that employ a combination of shearing, gouging, and/or plowing cutting elements have been proposed. As disclosed in U.S. Application Publication No. 2008/0173482 published Jul. 24, 2008 to Hall et al., now U.S. Pat. No. 7,641,002, issued Jan. 5, 2010, the disclosure of which is hereby incorporated herein in its entirety by this reference, a blade on a fixed-cutter drill bit may include both shearing cutting elements located in at least a shoulder region of the drill bit and cutting elements having a pointed geometry located in cone and nose regions of the drill bit. In addition, Hall discloses fixed-cutter drill bits having exclusively cutting elements having a pointed geometry attached to the blades thereof. U.S. application Ser. No. 12/793,396 filed Jun. 3, 2010, now U.S. Pat. No. 8,505,634, issued Aug. 13, 2013, to Lyons et al., the disclosure of which is hereby incorporated herein in its entirety by this reference, discloses that shearing cutting elements and gouging cutting elements may be disposed adjacent one another on a common blade of a fixed-cutter drill bit in various regions (e.g., the cone region, the nose region, and the shoulder region). U.S. application Ser. No. 13/022,288 filed Feb. 7, 2011 to Lyons et al., the disclosure of which is hereby incorporated herein in its entirety by this reference, discloses that gouging cutting elements may be disposed rotationally following shearing cutting elements (known in the art as a backup cutting element configuration) on a common blade of a fixed-cutter drill bit. U.K. Application Publication No. 2,086,451 published May 12, 1982 to Christensen, Inc., the disclosure of which is hereby incorporated herein in its entirety by this reference, discloses a fixed-cutter drill bit having only cutting elements with a planar cutting face on some blades and only cutting elements having a divided cutting face at a mutual angle of less than 180° on other blades. The cutting elements with a divided cutting face engrave furrows (i.e., plow) into the formation being drilled.

BRIEF DESCRIPTION OF THE DRAWINGS

While the specification concludes with claims particularly pointing out and distinctly claiming that which is regarded as the present invention, various features and advantages of embodiments of the disclosure may be more readily ascertained from the following description of embodiments of the disclosure when read in conjunction with the accompanying drawings, in which:

DETAILED DESCRIPTION

The illustrations presented herein are not meant to be actual views of any particular earth-boring tool or cutting element, but are merely idealized representations that are employed to describe the embodiments of the disclosure. Additionally, elements common between figures may retain the same or similar numerical designation.

Embodiments of the disclosure relate to earth-boring tools having only shearing cutting elements attached to at least one blade and only gouging cutting elements attached to at least another blade. In some embodiments, a number of blades to which only shearing cutting elements are attached may be greater than a number of blades to which only gouging cutting elements are attached. In other embodiments, a number of blades to which only gouging cutting elements are attached may be greater than a number of blades to which only shearing cutting elements are attached.

The terms "earth-boring tool" and "earth-boring drill bit," as used herein, mean and include any type of bit or tool used for drilling during the formation or enlargement of a wellbore in a subterranean formation and include, for example, fixed-cutter bits, fixed-cutter core bits, fixed-cutter eccentric bits, fixed-cutter bicenter bits, hybrid bits, as well as fixed-cutter reamers, mills, and other fixed cutter drilling bits and tools known in the art.

As used herein, the term "polycrystalline material" means and includes any structure comprising a plurality of grains (i.e., crystals) of material (e.g., superabrasive material) that are bonded directly together by inter-granular bonds. The crystal structures of the individual grains of the material may be randomly oriented in space within the polycrystalline material.

As used herein, the terms "inter-granular bond" and "inter-bonded" mean and include any direct atomic bond (e.g., covalent, metallic, etc.) between atoms in adjacent grains of superabrasive material.

As used herein, the term "superabrasive material" means and includes any material having a Knoop hardness value of about 3,000 $Kg_f/mm^2$ (29,420 MPa) or more. Superabrasive materials include, for example, diamond and cubic boron nitride. Superabrasive materials may also be characterized as "superhard" materials.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

As used herein, the term "shearing cutting element" means and includes any cutting element having a primary cutting mechanism that involves shearing an underlying earth formation.

As used herein, the "gouging cutting element" means and includes any cutting element having a primary cutting mechanism that involves gouging or crushing an underlying earth formation.

Figure 1:
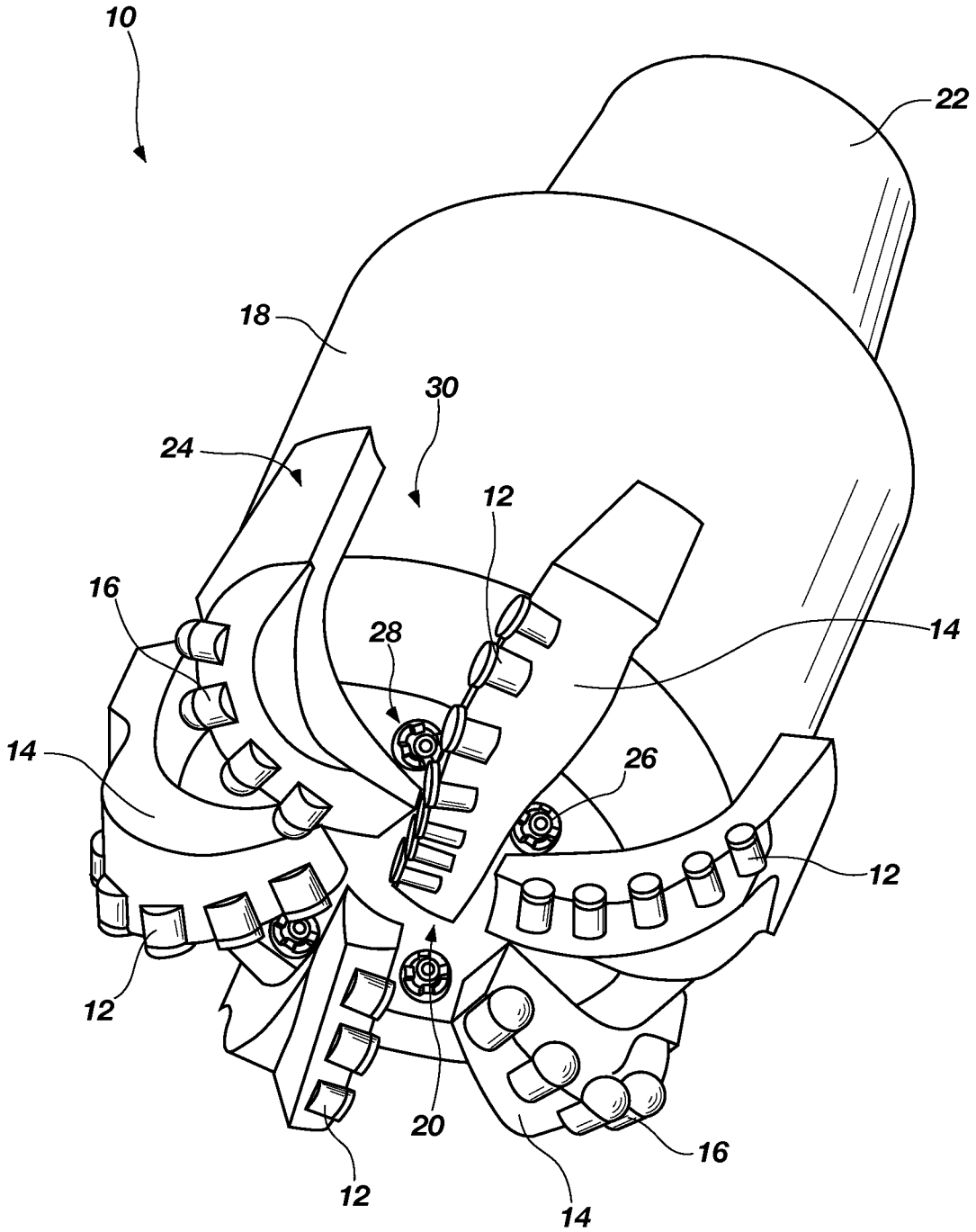
FIG. 1 is a perspective view of an earth-boring tool having shearing cutting elements attached to a greater number of blades than a number of blades to which gouging cutting elements are attached.

Referring to FIG. 1, an earth-boring tool 10 having only shearing cutting elements 12 attached to a greater number of blades 14 than a number of blades 14 to which only gouging cutting elements 16 are attached is shown. The earth-boring tool 10 comprises a bit body 18 and a plurality of radially extending blades 14 disposed at a face 20 thereof. The blades 14 may also extend longitudinally from the face 20 toward an end of the bit body 18 opposing the face 20, at which a shank 22 configured for attachment to a drill string may be disposed. The blades 14 may terminate at a gage region 24. Nozzles 26 located between the blades 14 may provide an outlet for drilling fluid, which may aid in removing cuttings and in cooling the earth-boring tool 10 and the components thereof. The nozzles 26 may be disposed in fluid courses 28 between the blades 14, and the fluid courses 28 may extend to junk slots 30 proximate the gage region 24.

Figure 2:
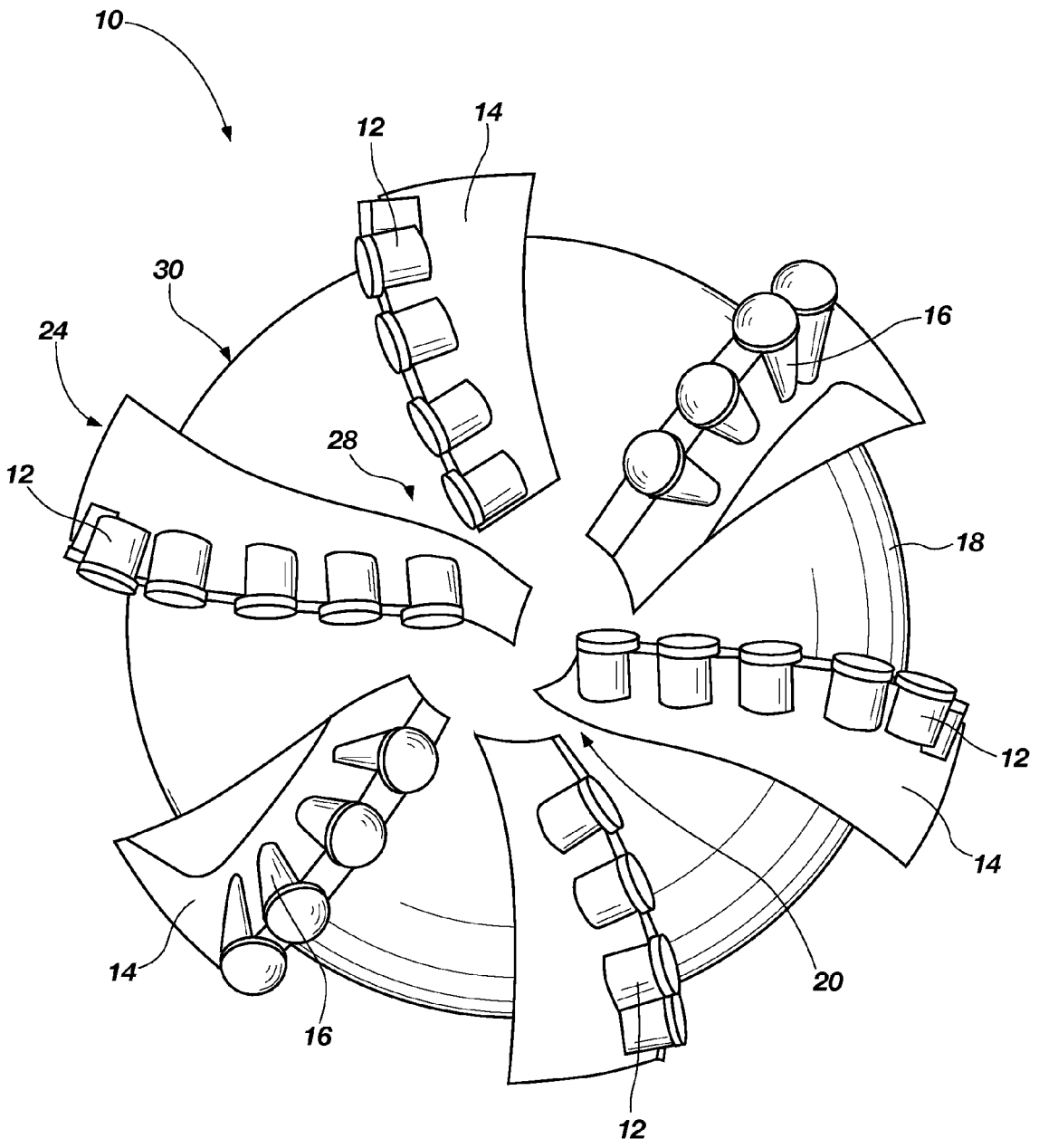
FIG. 2 depicts a plan view of the face of the earth-boring tool of FIG. 1.

Referring to FIG. 2, a plan view of the face 20 of the earth-boring tool 10 of FIG. 1 is shown. Some components, such as the nozzles 26 (see FIG. 1), have been omitted for the sake of simplicity. The total number of blades 14 extending from the body 18 of the earth-boring tool 10 may be even. For example, six blades 14 may extend from the body 18 of the earth-boring tool 10. Only shearing cutting elements 12 may be attached to a greater number of blades 14 than a number of blades 14 to which only gouging cutting elements 16 are attached. For example, only gouging cutting elements 16 may be attached to two blades 14 extending from the body 18 of the earth-boring tool 10. Thus, only shearing cutting elements 12 may be attached to at least three blades 14 extending from the body 18 of the earth-boring tool 10, and may be attached to each of the remaining four blades 14 where the total number of blades 14 is six. In other embodiments, only gouging cutting elements 16 may be attached to greater than two blades 14 extending from the body 18 of the earth-boring tool 10. In such embodiments, only shearing cutting elements 12 may be attached to greater than three blades 14 extending from the body 18 of the earth-boring tool 10.

The blades 14 extending from the body 18 of the earth-boring tool 10 may be disposed at angular positions that are spaced at least substantially equally apart. Locating the blades 14 at angular positions that are spaced at least substantially equally apart may aid in balancing the loads placed on the blades 14. For example, where the total number of blades 14 is six, each blade 14 may be about 60° from the blades 14 adjacent to it. Thus, both a rotationally leading and a rotationally following blade 14 may be about 60° from any selected blade 14 where the total number of blades 14 is six. The blades 14 to which only gouging cutting elements 16 are attached may be located at angular positions that are spaced at least substantially equally from one another. Thus, where gouging cutting elements 16 are attached to two blades 14 and the total number of blades 14 is even, the blades 14 to which the gouging cutting elements 16 are attached may be located about 180° apart.

In some embodiments, it may be undesirable to dispose blades 14 at angular positions that are spaced exactly equally apart. For example, it is believed that spacing all the blades 14 of an earth-boring tool 10 exactly equally apart in terms of angular position may cause the resulting earth-boring tool 10 to become unstable. Thus, the blades 14 may be deliberately disposed at angular positions that are not spaced exactly equally apart. For example, each blades 14 may be disposed at an angular position that is ±1°, ±5°, ±10°, ±15°, ±20°, ±30°, or even more or less from a location that would have placed the blades 14 exactly equally apart in some embodiments. Thus, when it is said that the blades 14 may be spaced "at least substantially equally apart" or are located "about" some number of degrees apart, what is meant is that the blades 14 may be deliberately displaced from a location that would have placed the blades 14 exactly equally apart.

Figure 2A:
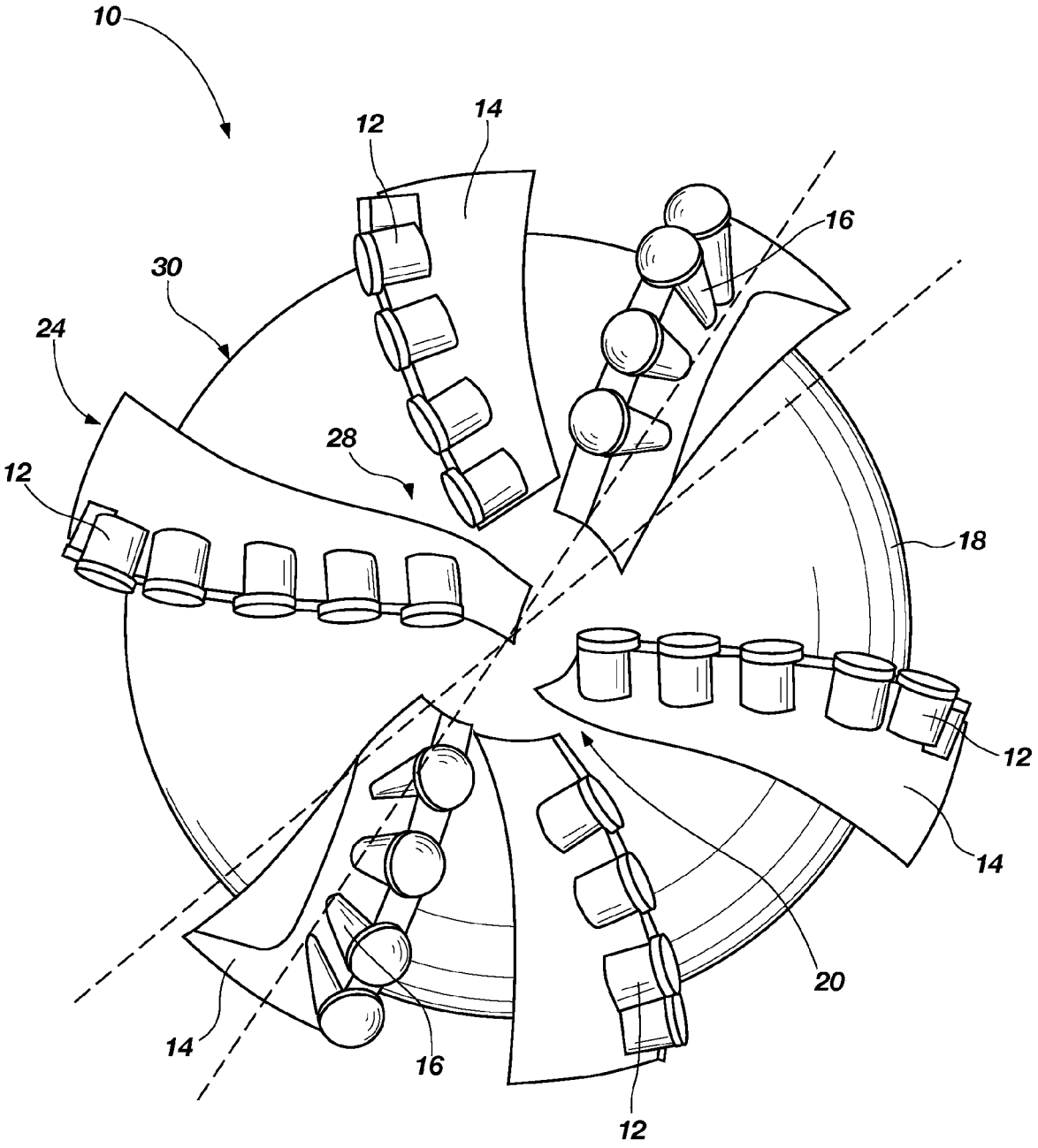
FIG. 2A is a plan view of an alternate configuration for the face shown in FIG. 2.

As a specific, non-limiting example, blades 14 to which only gouging cutting elements 16 are attached may be located at angular positions that are closer to immediately rotationally leading blades 14 to which only shearing cutting elements 12 are attached than if all the blades 14 were spaced exactly equally apart, as depicted in FIG. 2A. The blades 14 to which only gouging cutting elements 16 are attached may be about 15° closer to the blades 14 to which only shearing cutting elements 12 are attached that immediately rotationally lead the blades 14 to which only gouging cutting elements 16 are attached. In such an example, the relative proximity of the gouging cutting elements 16 to the shearing cutting elements 12 may enable the different cutting elements 12 and 16 to better balance the loading placed on each based on the application and/or the formation being drilled. Further, such a configuration may enable cuttings to be more easily removed from the cutting elements 12 and 16 and the blades 14 to which they are attached, thus reducing balling of the cuttings that may otherwise occur. In addition, the gouging cutting elements 16 may limit the depth of cut of the shearing cutting elements 12, which may be desirable in embodiments where the shearing cutting elements 12 are oriented at aggressive back rake angles (e.g., at low negative back rake angles, at a neutral back rake angle, and at positive back rake angles). In other embodiments, however, the blades 14 may be disposed at angular positions that are spaced exactly equally apart.

Locating the blades 14 to which only gouging cutting elements 16 are attached at angular positions that are spaced at least substantially equally from one another may mean that a maximum possible number of blades 14 to which only shearing cutting elements 12 are attached are interposed between the blades 14 to which only gouging cutting elements 16 are attached. Thus, the number of blades 14 to which only shearing cutting elements 12 are attached on one side of a blade 14 to which only gouging cutting elements 16 are attached may be equal to the number of blades 14 to which only shearing cutting elements 12 are attached on the other side of the blade 14 to which only gouging cutting elements 16 are attached in some embodiments. For example, where the total number of blades 14 is six and the number of blades 14 to which only gouging cutting elements 16 are attached is three, one blade 14 to which only shearing cutting elements 12 are attached may be interposed between each rotationally adjacent pair of blades 14 to which only gouging cutting elements 16 are attached. In such an example, the blades 14 to which only gouging cutting elements 16 are attached may be located about 120° apart.

Figure 3:
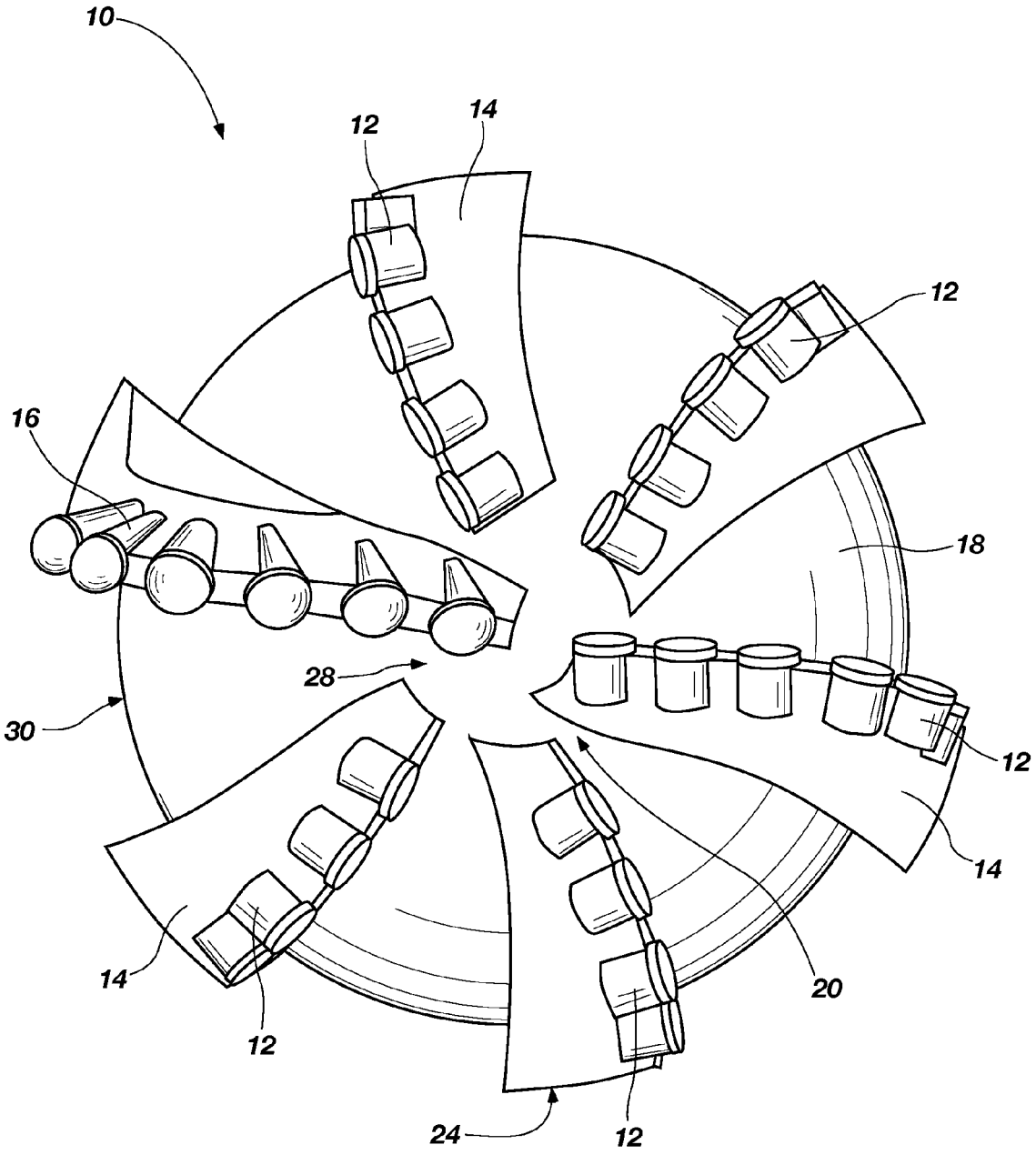
FIG. 3 illustrates a plan view of a face of an earth-boring tool having gouging cutting elements attached to only one blade.

Referring to FIG. 3, a plan view of a face 20 of another earth-boring tool 10 is shown. The total number of blades 14 extending from the body 18 of the earth-boring tool 10 may be even. For example, six blades 14 may extend from the body 18 of the earth-boring tool 10. Only shearing cutting elements 12 may be attached to a greater number of blades 14 than a number of blades 14 to which only gouging cutting elements 16 are attached. For example, only gouging cutting elements 16 may be attached to one blade 14 extending from the body 18 of the earth-boring tool 10. Thus, only shearing cutting elements 12 may be attached to at least two blades 14 extending from the body 18 of the earth-boring tool 10, and may be attached to each of the remaining five blades 14 where the total number of blades 14 is six.

The blades 14 extending from the body 18 of the earth-boring tool 10 may be disposed at angular positions that are spaced at least substantially equally apart. For example, where the total number of blades 14 is six, each blade 14 may be about 60° from the blades 14 adjacent to it. Thus, both a rotationally leading and a rotationally following blade 14 may be about 60° from any selected blade 14 where the total number of blades 14 is six.

Figure 4:
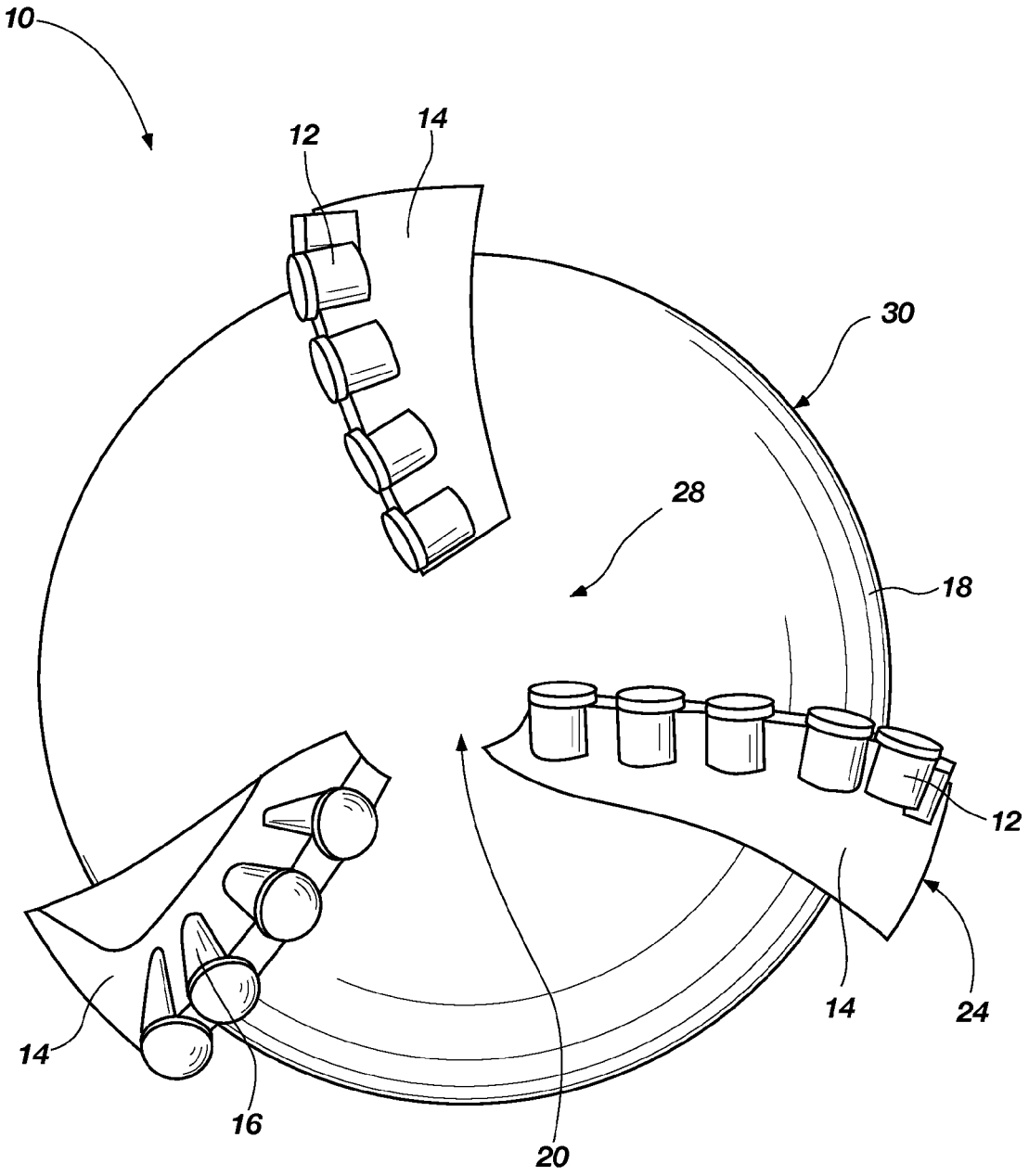
FIG. 4 is a plan view of a face of an earth-boring tool having three blades to which cutting elements are attached.

Referring to FIG. 4, a plan view of a face 20 of yet another earth-boring tool 10 is shown. The total number of blades 14 extending from the body 18 of the earth-boring tool 10 may be odd. For example, three blades 14 may extend from the body 18 of the earth-boring tool 10. Only shearing cutting elements 12 may be attached to a greater number of blades 14 than a number of blades 14 to which only gouging cutting elements 16 are attached. For example, only gouging cutting elements 16 may be attached to one blade 14 extending from the body 18 of the earth-boring tool 10. Thus, only shearing cutting elements 12 may be attached to at least two blades 14 extending from the body 18 of the earth-boring tool 10, and may be attached to each of the remaining two blades 14 where the total number of blades 14 is three.

The blades 14 extending from the body 18 of the earth-boring tool 10 may be disposed at angular positions that are spaced at least substantially equally apart. For example, where the total number of blades 14 is three, each blade 14 may be about 120° from the blades 14 adjacent to it. Thus, both a rotationally leading and a rotationally following blade 14 may be about 120° from any selected blade 14 where the total number of blades 14 is three.

Figure 5:
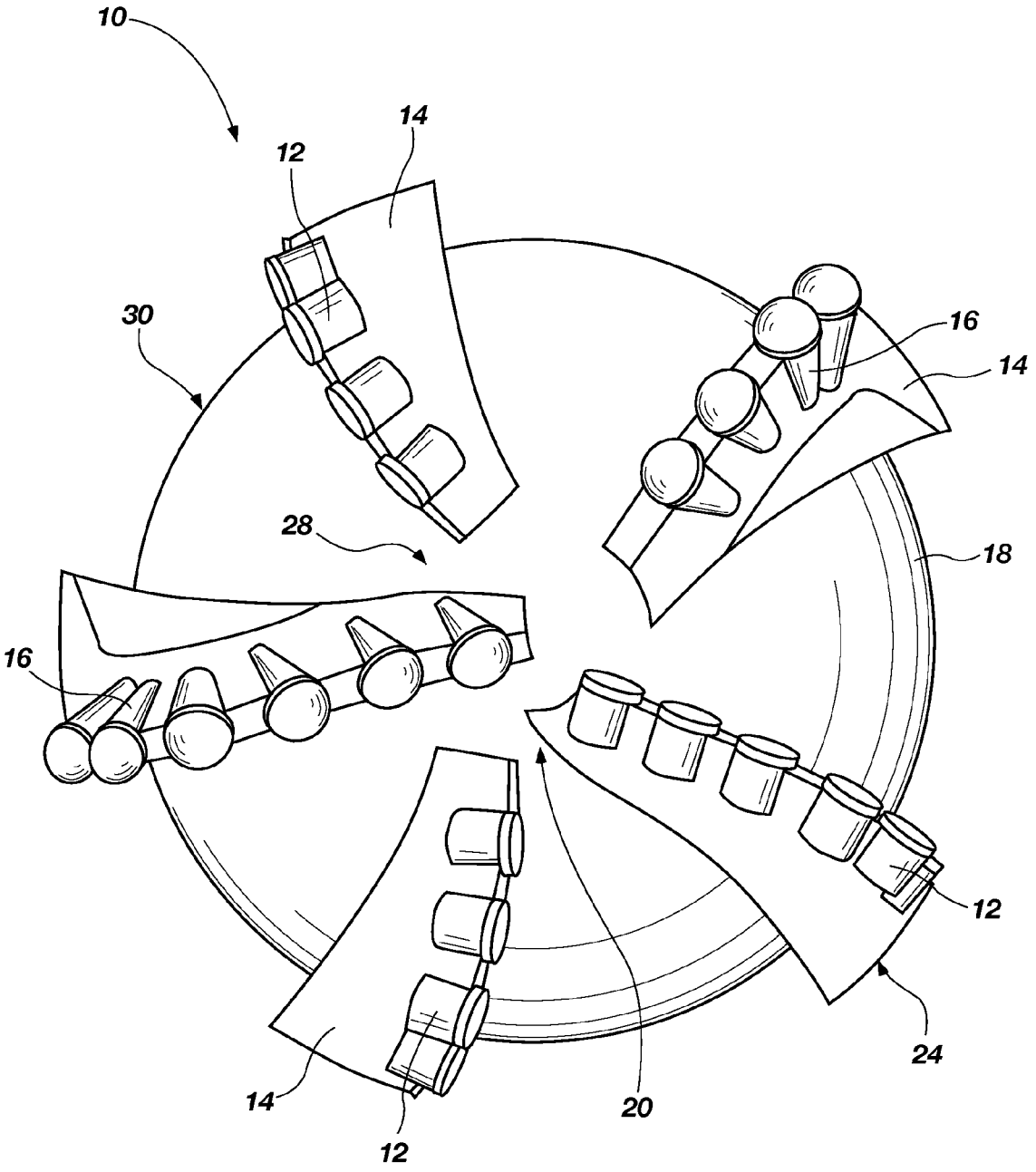
FIG. 5 depicts a plan view of a face of an earth-boring tool having five blades to which cutting elements are attached.

Referring to FIG. 5, a plan view of a face 20 of still another earth-boring tool 10 is shown. The total number of blades 14 extending from the body 18 of the earth-boring tool 10 may be odd. For example, five blades 14 may extend from the body 18 of the earth-boring tool 10. Only shearing cutting elements 12 may be attached to a greater number of blades 14 than a number of blades 14 to which only gouging cutting elements 16 are attached. For example, only gouging cutting elements 16 may be attached to two blades 14 extending from the body 18 of the earth-boring tool 10. Thus, only shearing cutting elements 12 may be attached to at least three blades 14 extending from the body 18 of the earth-boring tool 10, and may be attached to each of the remaining three blades 14 where the total number of blades 14 is five. In other embodiments, only gouging cutting elements 16 may be attached to greater than two blades 14 extending from the body 18 of the earth-boring tool 10. In such embodiments, only shearing cutting elements 12 may be attached to greater than three blades 14 extending from the body 18 of the earth-boring tool 10.

The blades 14 extending from the body 18 of the earth-boring tool 10 may be disposed at angular positions that are spaced at least substantially equally apart. For example, where the total number of blades 14 is five, each blade 14 may be about 72° from the blades 14 adjacent to it. Thus, both a rotationally leading and a rotationally following blade 14 may be about 72° from any selected blade 14 where the total number of blades 14 is five. The blades 14 to which only gouging cutting elements 16 are attached may be located at angular positions that are spaced at least substantially equally from one another. Thus, where only gouging cutting elements 16 are attached to two blades 14 and the total number of blades 14 is five, the blades 14 to which only gouging cutting elements 16 are attached may be located about 144° apart in a direction of rotation of the earth-boring tool 10 and may be located about 216° apart in a direction opposing rotation of the earth-boring tool 10.

Locating the blades 14 to which only gouging cutting elements 16 are attached at angular positions that are spaced at least substantially equally from one another may mean that a maximum possible number of blades 14 to which only shearing cutting elements 12 are attached is interposed between the blades 14 to which only gouging cutting elements 16 are attached. Thus, the number of blades 14 to which only shearing cutting elements 12 are attached on one side of a blade 14 to which only gouging cutting elements 16 are attached may not be equal to the number of blades 14 to which only shearing cutting elements 12 are attached on the other side of the blade 14 to which only gouging cutting elements 16 are attached in some embodiments. For example, where the total number of blades 14 is seven and the number of blades 14 to which only gouging cutting elements 16 are attached is two, three blades 14 to which only shearing cutting elements 12 are attached may be interposed between the blades 14 to which only gouging cutting elements 16 are attached on one side and two blades 14 to which only shearing cutting elements 12 are attached may be interposed between the blades 14 to which only gouging cutting elements 16 are attached on the other side. In such an example, the blades 14 to which only gouging cutting elements 16 are attached may be located about 206° apart on the one side and may be located about 154° apart on the other side.

Attaching only shearing cutting elements 12 to a greater number of blades 14 than a number of blades 14 to which only gouging cutting elements 16 are attached on an earth-boring tool 10, such as, for example, any of the earth-boring tools 10 shown in FIGS. 1 through 5, may improve the performance of the earth-boring tool 10 particularly in mixed formations. For example, where an earth formation to be drilled includes at least some relatively soft regions, such as, for example, regions of sand, shale, or clay, and at least some relatively hard regions, such as, for example, regions of hard limestone, hard sandstone, dolomite, or anhydrite, attaching some cutting elements that remove the underlying earth formation using primarily a shearing cutting mechanism (i.e., shearing cutting elements 12) and attaching some other cutting elements that remove the underlying earth formation using primarily a gouging or crushing cutting mechanism (i.e., gouging cutting elements 16) may improve the efficiency of the earth-boring tool 10, may prevent damage to the earth-boring tool 10, and may more effectively distribute loads placed on the earth-boring tool 10. As a specific, non-limiting example, where a projected drilling path passes primarily through relatively soft earth formations and at least one relatively hard formation, the gouging cutting elements 16 may provide enhanced earth removal within the relatively hard formation and may reduce the wear that would otherwise occur on the shearing cutting elements 12. Thus, the gouging cutting elements 16 may enable an earth-boring tool 10 to drill more efficiently through a formation than if only shearing cutting elements 12 were attached to the earth-boring tool 10.

Figure 6A:
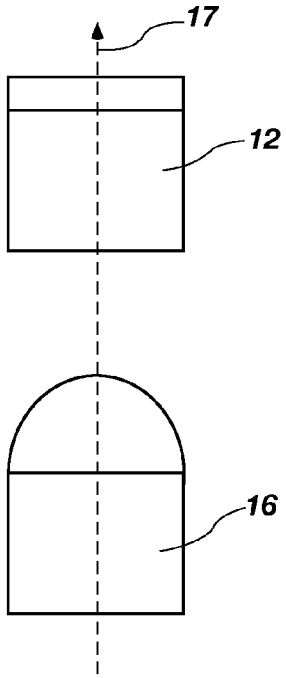
FIGS. 6A through 6D are simplified, schematic plan views of cutting paths for cutting elements attached to earth-boring tools.

Referring to FIG. 6A, a rotationally leading shearing cutting element 12 and a rotationally following gouging cutting element 16 are shown. Though the cutting elements 12 and 16 may travel in a spiral (e.g., helical) path when rotating in a borehole, the cutting elements 12 and 16 are illustrated with a linear path 17 for the sake of simplicity. As shown in FIG. 6A, a rotationally following gouging cutting element 16 may cut a kerf, also known in the art as a swath or groove, the center of which is at least substantially aligned with the center of the kerf of the rotationally leading shearing cutting element 12. Thus, each rotationally following gouging cutting element 16 attached to an earth-boring tool 10 (see FIGS. 1 through 5) may be at least substantially aligned with a corresponding rotationally leading shearing cutting element 12 in some embodiments. Such a cutting element configuration may increase the stability of the earth-boring tool 10 (see FIGS. 1 through 5) to which the cutting elements 12 and 16 are attached and render the earth-boring tool 10 (see FIGS. 1 through 5) self-centering (i.e., able to drill an at least substantially vertical borehole). In some embodiments, the cutting elements 12 and 16 may have equal or differing exposures (i.e., the distance the cutting elements 12 and 16 extend above the blades 14 to which they are attached) and may have equal or differing backrake and siderake angles.

Figure 6B:
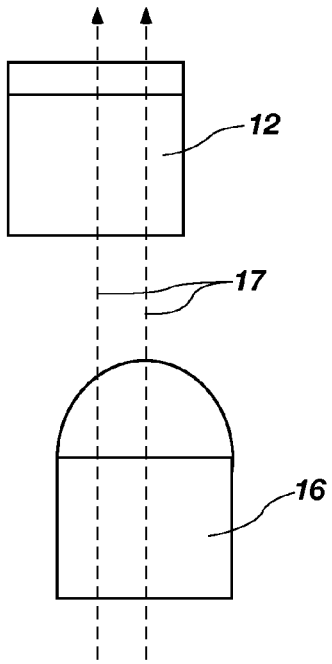

Referring to FIG. 6B, a rotationally leading shearing cutting element 12 and a rotationally following gouging cutting element 16 are shown. As shown in FIG. 6B, a rotationally following gouging cutting element 16 may cut a kerf, the center of which is offset from the center of the kerf of the rotationally leading shearing cutting element 12. Such a cutting element configuration may improve borehole cutting element coverage of the earth-boring tool 10 (see FIGS. 1 through 5) to which the cutting elements 12 and 16 are attached, which may be advantageous in applications where off-center rotation is necessary, such as, for example, in directional drilling, and cause the earth-boring tool 10 (see FIGS. 1 through 5) to wander (i.e., drill a non-linear, such as, for example, helical, borehole). Up to one-half of the diameter of the rotationally following gouging cutting element 16 may extend beyond the side of the rotationally leading shearing cutting element 12 in some embodiments. In some embodiments, the cutting elements 12 and 16 may have equal or differing exposures (i.e., the distance the cutting elements 12 and 16 extend above the blades 14 to which they are attached) and may have equal or differing backrake and siderake angles.

Figure 6C:
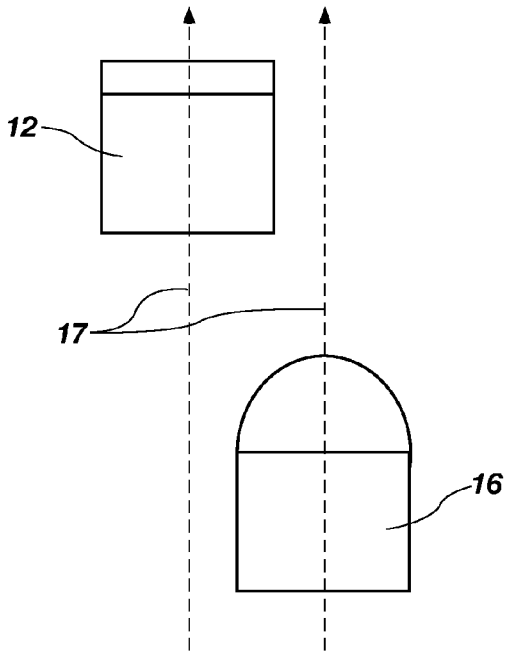

Referring to FIG. 6C, a rotationally leading shearing cutting element 12 and a rotationally following gouging cutting element 16 are shown. As shown in FIG. 6C, a rotationally following gouging cutting element 16 may cut a kerf, the center of which is offset from the center of the kerf of the rotationally leading shearing cutting element 12. Greater than one-half of the diameter of the rotationally following gouging cutting element 16 may extend beyond the side of the rotationally leading shearing cutting element 12 in some embodiments. In some embodiments, the cutting elements 12 and 16 may have equal or differing exposures (i.e., the distance the cutting elements 12 and 16 extend above the blades 14 to which they are attached) and may have equal or differing backrake and siderake angles.

Figure 6D:
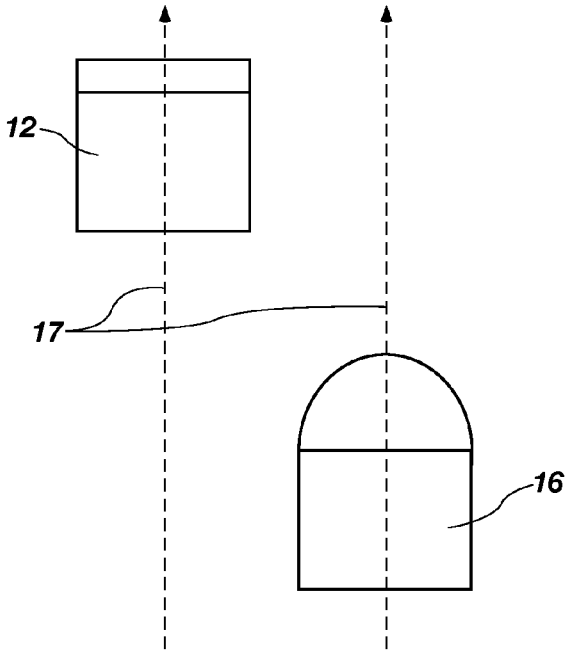

Referring to FIG. 6D, a rotationally leading shearing cutting element 12 and a rotationally following gouging cutting element 16 are shown. As shown in FIG. 6D, a rotationally following gouging cutting element 16 may cut a groove, the center of which is offset from the center of the groove of the rotationally leading shearing cutting element 12. None of the groove cut by the rotationally following gouging cutting element 16 may overlap with the groove cut by the rotationally leading shearing cutting element 12 in some embodiments. In some embodiments, the cutting elements 12 and 16 may have equal or differing exposures (i.e., the distance the cutting elements 12 and 16 extend above the blades 14 to which they are attached) and may have equal or differing backrake and siderake angles.

Figure 7:
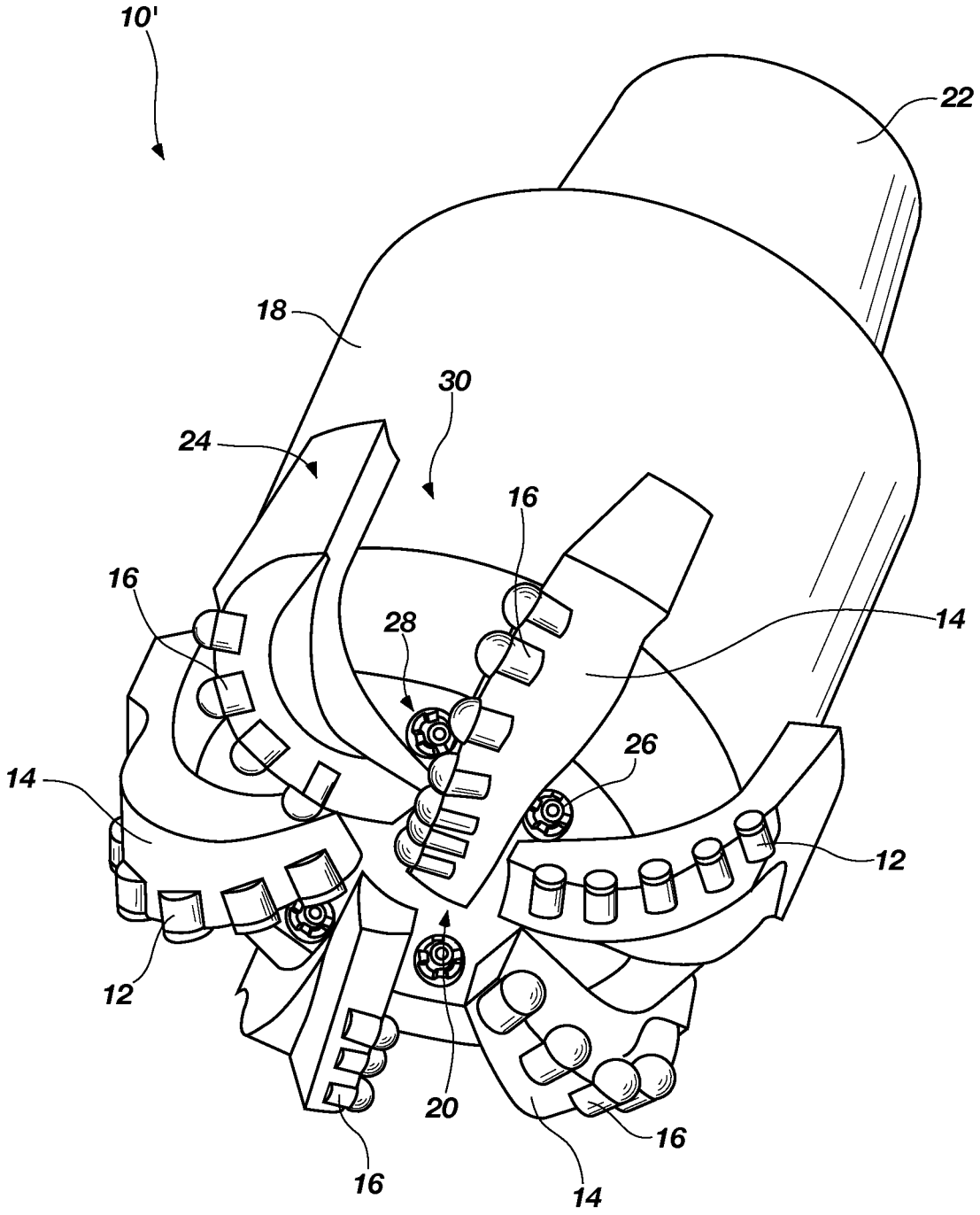
FIG. 7 illustrates a perspective view of an earth-boring tool having gouging cutting elements attached to a greater number of blades than a number of blades to which shearing cutting elements are attached.

Referring to FIG. 7, an earth-boring tool 10' having only gouging cutting elements 16 attached to a greater number of blades 14 than a number of blades 14 to which only shearing cutting elements 12 are attached is shown. The earth-boring tool 10' comprises a bit body 18 and a plurality of radially extending blades 14 disposed at a face 20 thereof. The blades 14 may also extend longitudinally from the face 20 toward an end of the bit body 18 opposing the face 20, at which a shank 22 configured for attachment to a drill string may be disposed, to a gage region 24. Nozzles 26 between the blades 14 may provide an outlet for drilling fluid, which may aid in removing cuttings and in cooling the earth-boring tool 10' and the components thereof. The nozzles 26 may be disposed in fluid courses 28 between the blades 14, and the fluid courses 28 may extend to junk slots 30 proximate the gage region 24.

Figure 8:
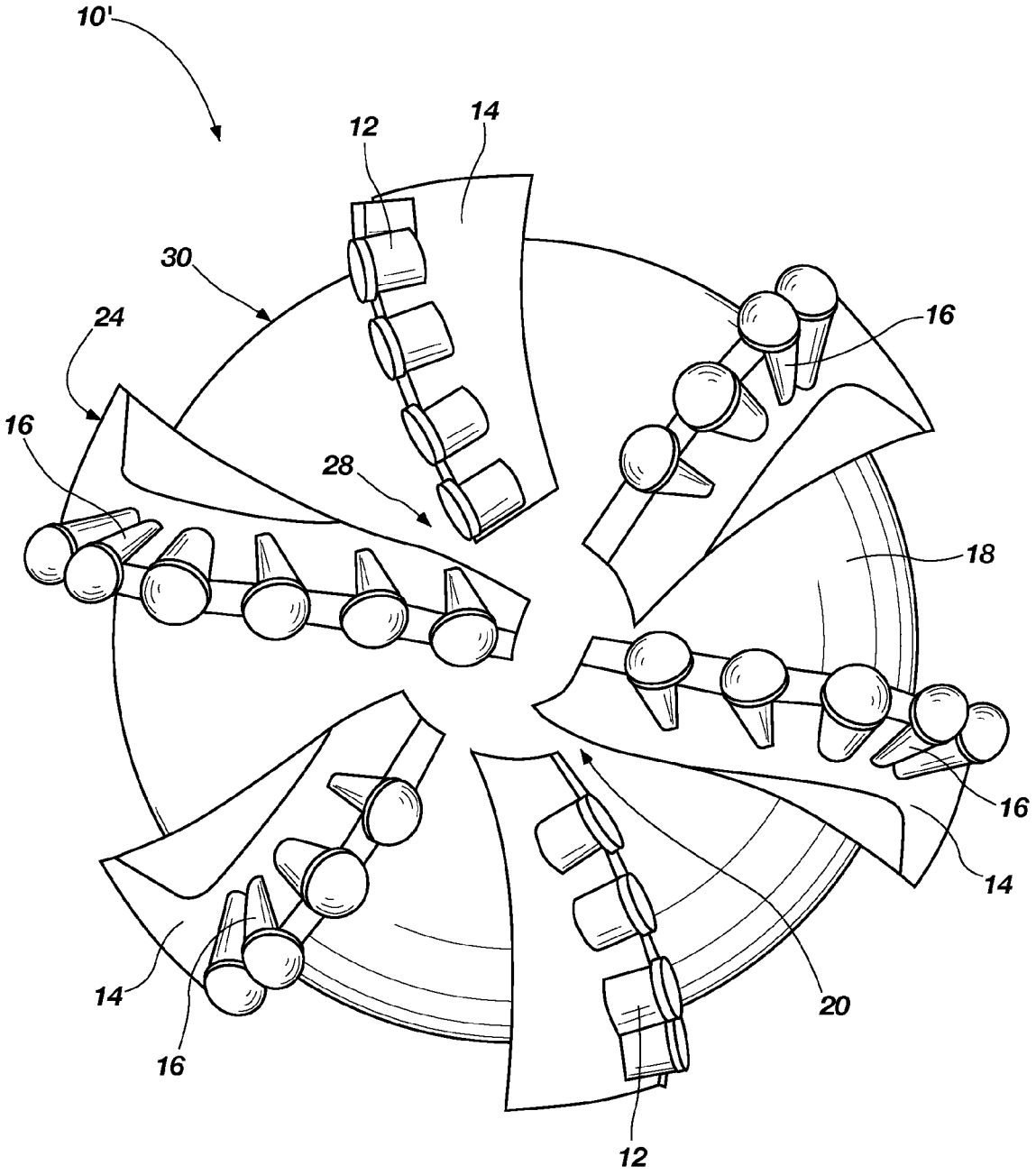
FIG. 8 is a plan view of the face of the earth-boring tool of FIG. 6.

Referring to FIG. 8, a plan view of the face 20 of the earth-boring tool 10' of FIG. 6 is shown. Some components, such as the nozzles 26 (see FIG. 6), have been omitted for the sake of simplicity. The total number of blades 14 extending from the body 18 of the earth-boring tool 10' may be even. For example, six blades 14 may extend from the body 18 of the earth-boring tool 10'. Only gouging cutting elements 16 may be attached to a greater number of blades 14 than a number of blades 14 to which only shearing cutting elements 12 are attached. For example, only shearing cutting elements 12 may be attached to two blades 14 extending from the body 18 of the earth-boring tool 10'. Thus, only gouging cutting elements 16 may be attached to at least three blades 14 extending from the body 18 of the earth-boring tool 10', and may be attached to each of the remaining four blades 14 where the total number of blades 14 is six. In other embodiments, only shearing cutting elements 12 may be attached to greater than two blades 14 extending from the body 18 of the earth-boring tool 10'. In such embodiments, only gouging cutting elements 16 may be attached to greater than three blades 14 extending from the body 18 of the earth-boring tool 10'.

The blades 14 extending from the body 18 of the earth-boring tool 10' may be disposed at angular positions that are spaced at least substantially equally apart. Locating the blades 14 at angular positions that are spaced at least substantially equally apart may aid in balancing the loads placed on the blades 14. For example, where the total number of blades 14 is six, each blade 14 may be about 60° from the blades 14 adjacent to it. Thus, both a rotationally leading and a rotationally following blade 14 may be about 60° from any selected blade 14 where the total number of blades 14 is six. The blades 14 to which only shearing cutting elements 12 are attached may be located at angular positions that are spaced at least substantially equally from one another. Thus, where only shearing cutting elements 12 are attached to two blades 14 and the total number of blades 14 is even, the blades 14 to which only shearing cutting elements 12 are attached may be located about 180° apart.

Locating the blades 14 to which only shearing cutting elements 12 are attached at angular positions that are spaced at least substantially equally from one another may mean that a maximum possible number of blades 14 to which only gouging cutting elements 16 are attached are interposed between the blades 14 to which only shearing cutting elements 12 are attached. Thus, the number of blades 14 to which only gouging cutting elements 16 are attached on one side of a blade 14 to which only shearing cutting elements 12 are attached may be equal to the number of blades 14 to which only gouging cutting elements 16 are attached on the other side of the blade 14 to which only shearing cutting elements 12 are attached in some embodiments. For example, where the total number of blades 14 is seven and the number of blades 14 to which only shearing cutting elements 12 are attached is three, one blade 14 to which only gouging cutting elements 16 are attached may be interposed between each rotationally adjacent pair of blades 14 to which only shearing cutting elements 12 are attached. In such an example, the blades 14 to which only shearing cutting elements 12 are attached may be located about 120° apart.

Figure 9:
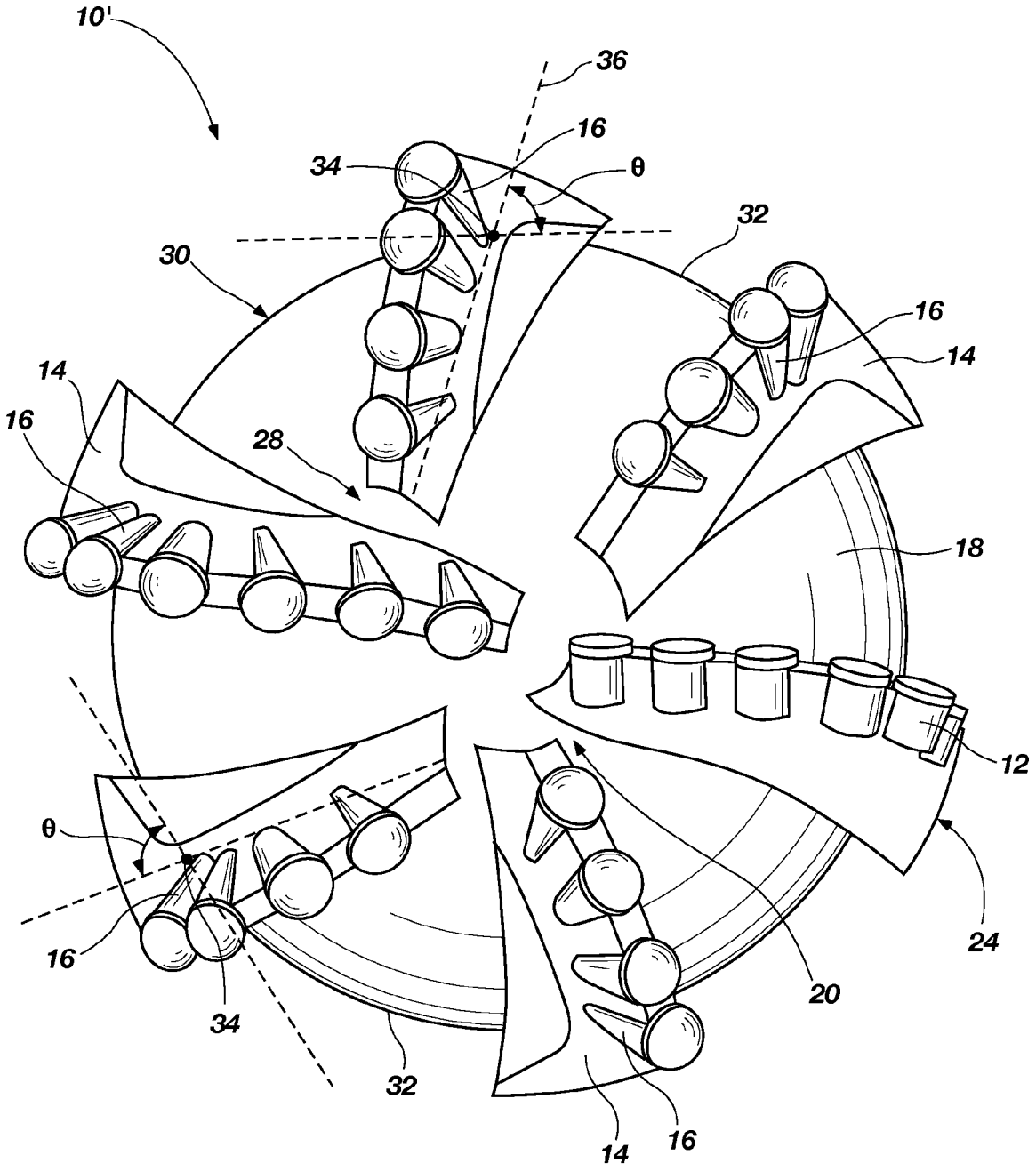
FIG. 9 depicts a plan view of a face of an earth-boring tool having shearing cutting elements attached to only one blade.

Referring to FIG. 9, a plan view of a face 20 of another earth-boring tool 10' is shown. The total number of blades 14 extending from the body 18 of the earth-boring tool 10' may be even. For example, six blades 14 may extend from the body 18 of the earth-boring tool 10'. Only gouging cutting elements 16 may be attached to a greater number of blades 14 than a number of blades 14 to which only shearing cutting elements 12 are attached. For example, only shearing cutting elements 12 may be attached to one blade 14 extending from the body 18 of the earth-boring tool 10'. Thus, only gouging cutting elements 16 may be attached to at least two blades 14 extending from the body 18 of the earth-boring tool 10', and may be attached to each of the remaining five blades 14 where the total number of blades 14 is six.

The blades 14 extending from the body 18 of the earth-boring tool 10' may be disposed at angular positions that are spaced at least substantially equally apart. For example, where the total number of blades 14 is six, each blade 14 may be about 60° from the blades 14 adjacent to it. Thus, both a rotationally leading and a rotationally following blade 14 may be about 60° from any selected blade 14 where the total number of blades 14 is six.

In some embodiments, at least one of the blades 14 to which only gouging cutting elements 16 are attached may be canted to extend in a direction that forms an oblique angle θ with a line tangent at a point of intersection 34 of a central axis 36 of the blade 14 with a radially outer surface 32 of the bit body 18 from which the blade 14 protrudes. For example, at least one of the five blades 14 to which only gouging cutting elements 16 are attached may extend in a direction that forms an oblique angle θ with a line tangent to the radially outer surface 32 of the bit body 18. Thus, others of the blades 14 to which only gouging cutting elements 16 are attached may extend in a direction perpendicular to a line tangent to the radially outer surface 32 of the bit body 18. The oblique angle θ at which the blades 14 may be canted may be greater than 45° and less than 90°, for example. As specific, non-limiting examples, the oblique angle θ may be about 60°, about 70°, or about 80°. In some embodiments, the oblique angles θ at which each of the blades 14 to which only gouging cutting elements 16 are attached may be at least substantially equal. In other embodiments, at least one blade 14 may be canted at an oblique angle θ that is different (e.g., greater than or smaller than) the oblique angle θ at which at least another blade 14 is canted. For example, each blade 14 may be canted at a unique oblique angle θ that is different from the oblique angle θ at which each other blade 14 is canted. Canting the blades 14 to which only gouging cutting elements 16 are attached may enable cuttings that have been removed from an underlying earth formation to more effectively be flushed from the gouging cutting elements 16 and the blades 14 to which they are attached. Thus, balling (i.e., sticking) of the cuttings to the gouging cutting elements 16 and the blades 14 to which they are attached may be reduced as compared to embodiments where the blades 14 are not canted.

Figure 10:
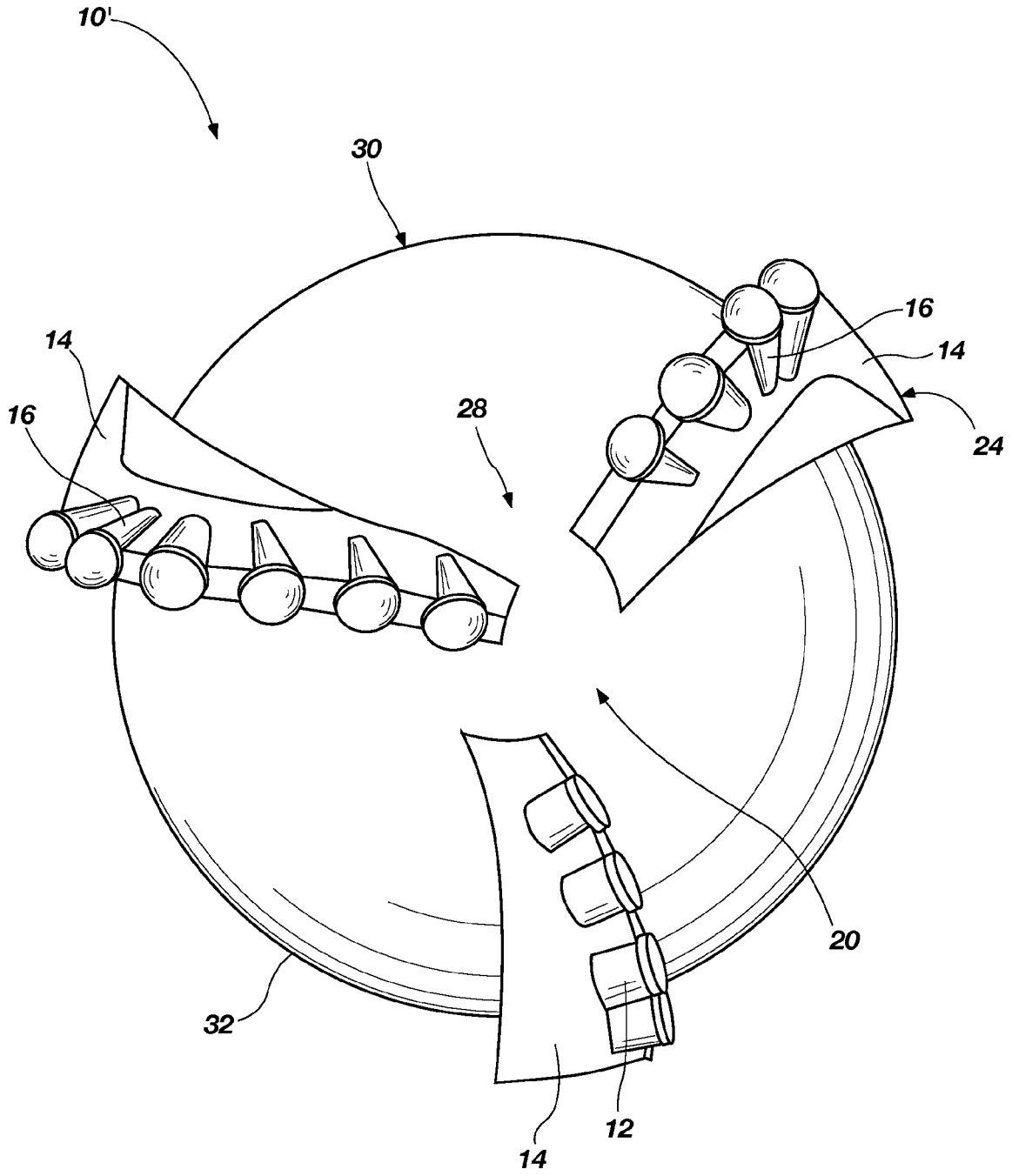
FIG. 10 illustrates a plan view of an earth-boring tool having three blades to which cutting elements are attached.

Referring to FIG. 10, a plan view of a face 20 of yet another earth-boring tool 10' is shown. The total number of blades 14 extending from the body 18 of the earth-boring tool 10' may be odd. For example, three blades 14 may extend from the body 18 of the earth-boring tool 10'. Only gouging cutting elements 16 may be attached to a greater number of blades 14 than a number of blades 14 to which only shearing cutting elements 12 are attached. For example, only shearing cutting elements 12 may be attached to one blade 14 extending from the body 18 of the earth-boring tool 10'. Thus, only gouging cutting elements 16 may be attached to at least two blades 14 extending from the body 18 of the earth-boring tool 10', and may be attached to each of the remaining two blades 14 where the total number of blades 14 is three.

The blades 14 extending from the body 18 of the earth-boring tool 10' may be disposed at angular positions that are spaced at least substantially equally apart. For example, where the total number of blades 14 is three, each blade 14 may be about 120° from the blades 14 adjacent to it. Thus, both a rotationally leading and a rotationally following blade 14 may be about 120° from any selected blade 14 where the total number of blades 14 is three.

Figure 11:
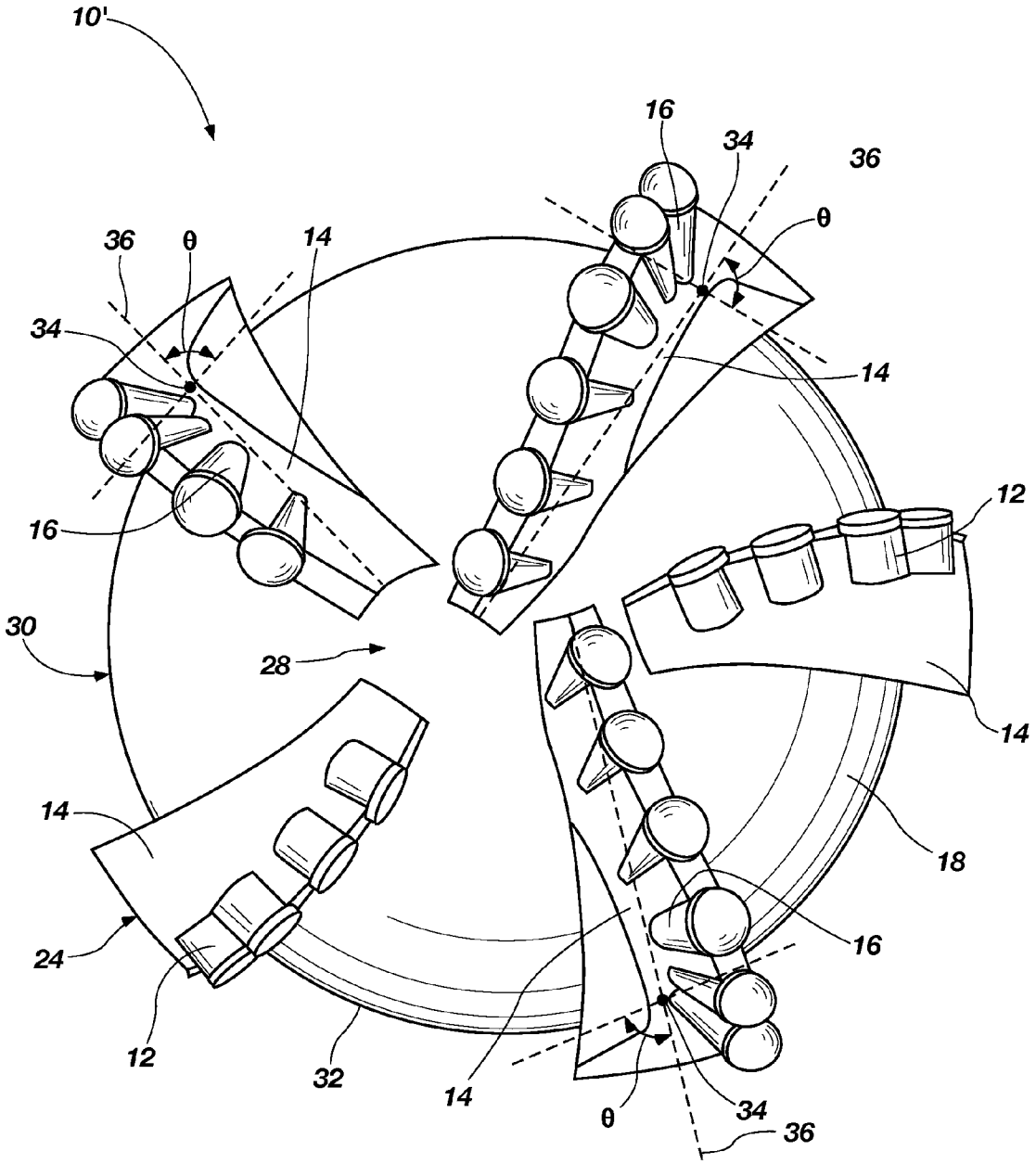
FIG. 11 is a plan view of an earth-boring tool having five blades to which cutting elements are attached.

Referring to FIG. 11, a plan view of a face 20 of still another earth-boring tool 10' is shown. The total number of blades 14 extending from the body 18 of the earth-boring tool 10' may be odd. For example, five blades 14 may extend from the body 18 of the earth-boring tool 10'. Only gouging cutting elements 16 may be attached to a greater number of blades 14 than a number of blades 14 to which only shearing cutting elements 12 are attached. For example, only shearing cutting elements 12 may be attached to two blades 14 extending from the body 18 of the earth-boring tool 10'. Thus, only gouging cutting elements 16 may be attached to at least three blades 14 extending from the body 18 of the earth-boring tool 10', and may be attached to each of the remaining three blades 14 where the total number of blades 14 is five. In other embodiments, only shearing cutting elements 12 may be attached to greater than two blades 14 extending from the body 18 of the earth-boring tool 10'. In such embodiments, only gouging cutting elements 16 may be attached to greater than three blades 14 extending from the body 18 of the earth-boring tool 10'.

The blades 14 extending from the body 18 of the earth-boring tool 10' may be disposed at angular positions that are spaced at least substantially equally apart. For example, where the total number of blades 14 is five, each blade 14 may be about 72° from the blades 14 adjacent to it. Thus, both a rotationally leading and a rotationally following blade 14 may be about 72° from any selected blade 14 where the total number of blades 14 is five. The blades 14 to which only gouging cutting elements 16 are attached may be located at angular positions that are spaced at least substantially equally from one another. Thus, where only gouging cutting elements 16 are attached to two blades 14 and the total number of blades 14 is five, the blades 14 to which only gouging cutting elements 16 are attached may be located about 144° apart in a direction of rotation of the earth-boring tool 10 and may be located about 216° apart in a direction opposing rotation of the earth-boring tool 10.

In some embodiments, at least one of the blades 14 to which only gouging cutting elements 16 are attached may be canted to extend in a direction that forms an oblique angle θ with a line tangent at a point of intersection 34 of a central axis 36 of the blade 14 with a radially outer surface 32 of the bit body 18 from which the blade 14 protrudes. For example, three of the five blades 14 to which only gouging cutting elements 16 are attached may extend in a direction that forms an oblique angle θ with a line tangent to the radially outer surface 32 of the bit body 18. Thus, each of the blades 14 to which only gouging cutting elements 16 are attached may be canted. In other embodiments, at least one blade 14 to which only gouging cutting elements 16 are attached may extend in a direction perpendicular to a line tangent to the radially outer surface 32 of the bit body 18. The oblique angle θ at which the blades 14 may be canted may be greater than 45° and less than 90°, for example. As specific, non-limiting examples, the oblique angle θ may be about 60°, about 70°, or about 80°. In some embodiments, the oblique angles θ at which each of the blades 14 to which only gouging cutting elements 16 are attached may be at least substantially equal. In other embodiments, at least one blade 14 may be canted at an oblique angle θ that is different (e.g., greater than or smaller than) the oblique angle θ at which at least another blade 14 is canted. For example, each blade 14 may be canted at a unique oblique angle θ that is different from the oblique angle θ at which each other blade 14 is canted. Canting the blades 14 to which only gouging cutting elements 16 are attached may enable cuttings that have been removed from an underlying earth formation to more effectively be flushed from the gouging cutting elements 16 and the blades 14 to which they are attached. Thus, balling (i.e., sticking) of the cuttings to the gouging cutting elements 16 and the blades 14 to which they are attached may be reduced as compared to embodiments where the blades 14 are not canted.

Attaching only gouging cutting elements 16 to a greater number of blades 14 than a number of blades 14 to which only shearing cutting elements 16 are attached on an earth-boring tool 10', such as, for example, any of the earth-boring tools 10' shown in FIGS. 6 through 10, may improve the performance of the earth-boring tool 10' particularly in mixed formations. For example, where an earth formation to be drilled includes at least some relatively soft regions, such as, for example, regions of sand, shale, or clay, and at least some relatively hard regions, such as, for example, regions of hard limestone, hard sandstone, dolomite, or anhydrite, attaching some cutting elements that remove the underlying earth formation using primarily a shearing cutting mechanism (i.e., shearing cutting elements 12) and attaching some other cutting elements that remove the underlying earth formation using primarily a gouging or crushing cutting mechanism (i.e., gouging cutting elements 16) may improve the efficiency of the earth-boring tool 10', may prevent damage to the earth-boring tool 10', and may more effectively distribute loads placed on the earth-boring tool 10'. As a specific, non-limiting example, where a projected drilling path passes primarily through relatively hard earth formations and at least one relatively soft formation, the shearing cutting elements 12 may provide enhanced earth removal within the relatively soft formation and may reduce the wear that would otherwise occur on the gouging cutting elements 16. Thus, the shearing cutting elements 12 may enable an earth-boring tool 10' to drill more efficiently through a formation than if only gouging cutting elements 16 were attached to the earth-boring tool 10'.

Figure 12A:
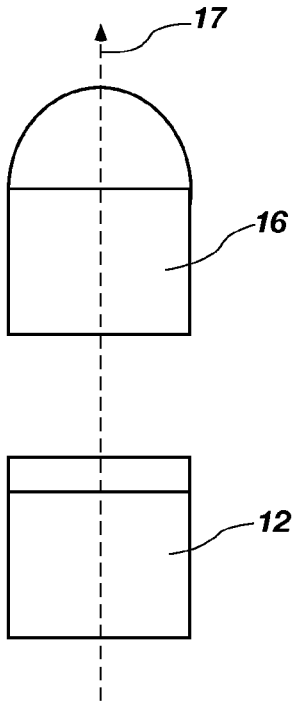
FIGS. 12A through 12D are simplified, schematic plan views of cutting paths for cutting elements attached to earth-boring tools.

Referring to FIG. 12A, a rotationally leading gouging cutting element 16 and a rotationally following shearing cutting element 12 are shown. Though the cutting elements 12 and 16 may travel in a spiral (e.g., helical) path when rotating in a borehole, the cutting elements 12 and 16 are illustrated with a linear path 17 for the sake of simplicity. As shown in FIG. 12A, a rotationally following shearing cutting element 12 may cut a kerf, the center of which is at least substantially aligned with the center of the kerf of the rotationally leading gouging cutting element 16. Thus, each rotationally following shearing cutting element 12 attached to an earth-boring tool 10' (see FIGS. 7 through 11) may be at least substantially aligned with a corresponding rotationally leading gouging cutting element 16 in some embodiments. In other embodiments, at least one rotationally following shearing cutting element 12 may be offset from a corresponding rotationally leading gouging cutting element 16. Such a cutting element configuration may increase the stability of the earth-boring tool 10' (see FIGS. 7 through 11) to which the cutting elements 12 and 16 are attached and render the earth-boring tool 10' (see FIGS. 7 through 11) self-centering (i.e., able to drill an at least substantially vertical borehole). In some embodiments, the cutting elements 12 and 16 may have equal or differing exposures (i.e., the distance the cutting elements 12 and 16 extend above the blades 14 to which they are attached) and may have equal or differing backrake and siderake angles.

Figure 12B:
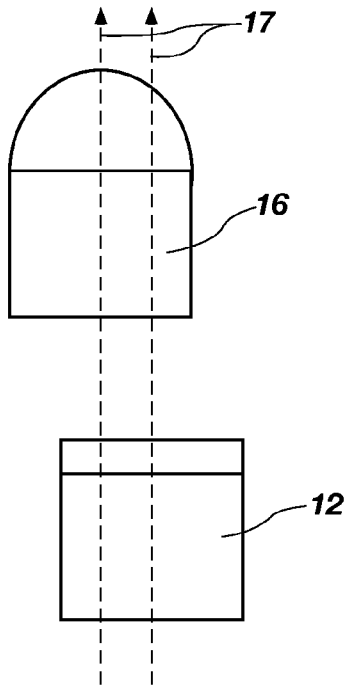

Referring to FIG. 12B, a rotationally leading gouging cutting element 16 and a rotationally following shearing cutting element 12 are shown. As shown in FIG. 12B, a rotationally following shearing cutting element 12 may cut a kerf, the center of which is offset from the center of the kerf of the rotationally leading gouging cutting element 16. Up to one-half of the diameter of the rotationally following shearing cutting element 12 may extend beyond the side of the rotationally leading gouging cutting element 16 in some embodiments. Such a cutting element configuration may improve borehole cutting element coverage of the earth-boring tool 10 (see FIGS. 1 through 5) to which the cutting elements 12 and 16 are attached, which may be advantageous in applications where off-center rotation is necessary, such as, for example, in directional drilling, and cause the earth-boring tool 10 (see FIGS. 1 through 5) to wander (i.e., drill a non-linear, such as, for example, helical, borehole). In some embodiments, the cutting elements 12 and 16 may have equal or differing exposures (i.e., the distance the cutting elements 12 and 16 extend above the blades 14 to which they are attached) and may have equal or differing backrake and siderake angles.

Figure 12C:
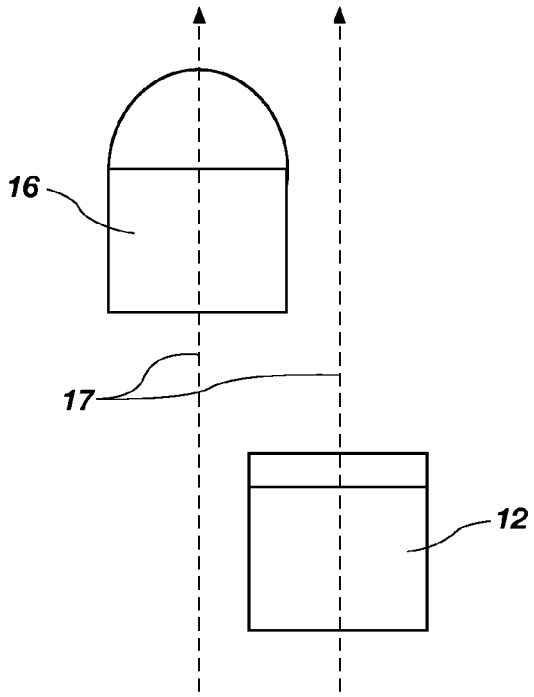

Referring to FIG. 12C, a rotationally leading gouging cutting element 16 and a rotationally following shearing cutting element 12 are shown. As shown in FIG. 12C, a rotationally following shearing cutting element 12 may cut a kerf, the center of which is offset from the center of the kerf of the rotationally leading gouging cutting element 16. Greater than one-half of the diameter of the rotationally following shearing cutting element 12 may extend beyond the side of the rotationally leading gouging cutting element 16 in some embodiments. In some embodiments, the cutting elements 12 and 16 may have equal or differing exposures (i.e., the distance the cutting elements 12 and 16 extend above the blades 14 to which they are attached) and may have equal or differing backrake and siderake angles.

Figure 12D:
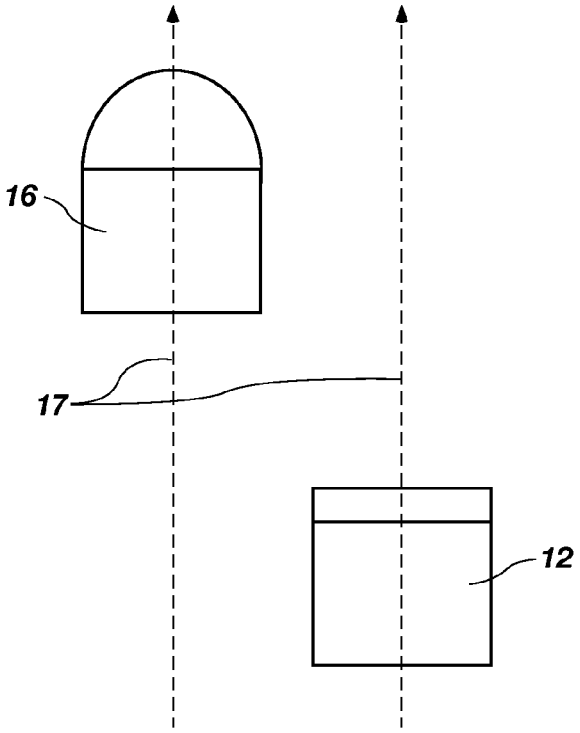

Referring to FIG. 12D, a rotationally leading gouging cutting element 16 and a rotationally following shearing cutting element 12 are shown. As shown in FIG. 12D, a rotationally following shearing cutting element 12 may cut a groove, the center of which is offset from the center of the groove of the rotationally leading gouging cutting element 16. None of the groove cut by the rotationally following shearing cutting element 12 may overlap with the groove cut by the rotationally leading gouging cutting element 16 in some embodiments. In some embodiments, the cutting elements 12 and 16 may have equal or differing exposures (i.e., the distance the cutting elements 12 and 16 extend above the blades 14 to which they are attached) and may have equal or differing backrake and siderake angles.

Figure 13:
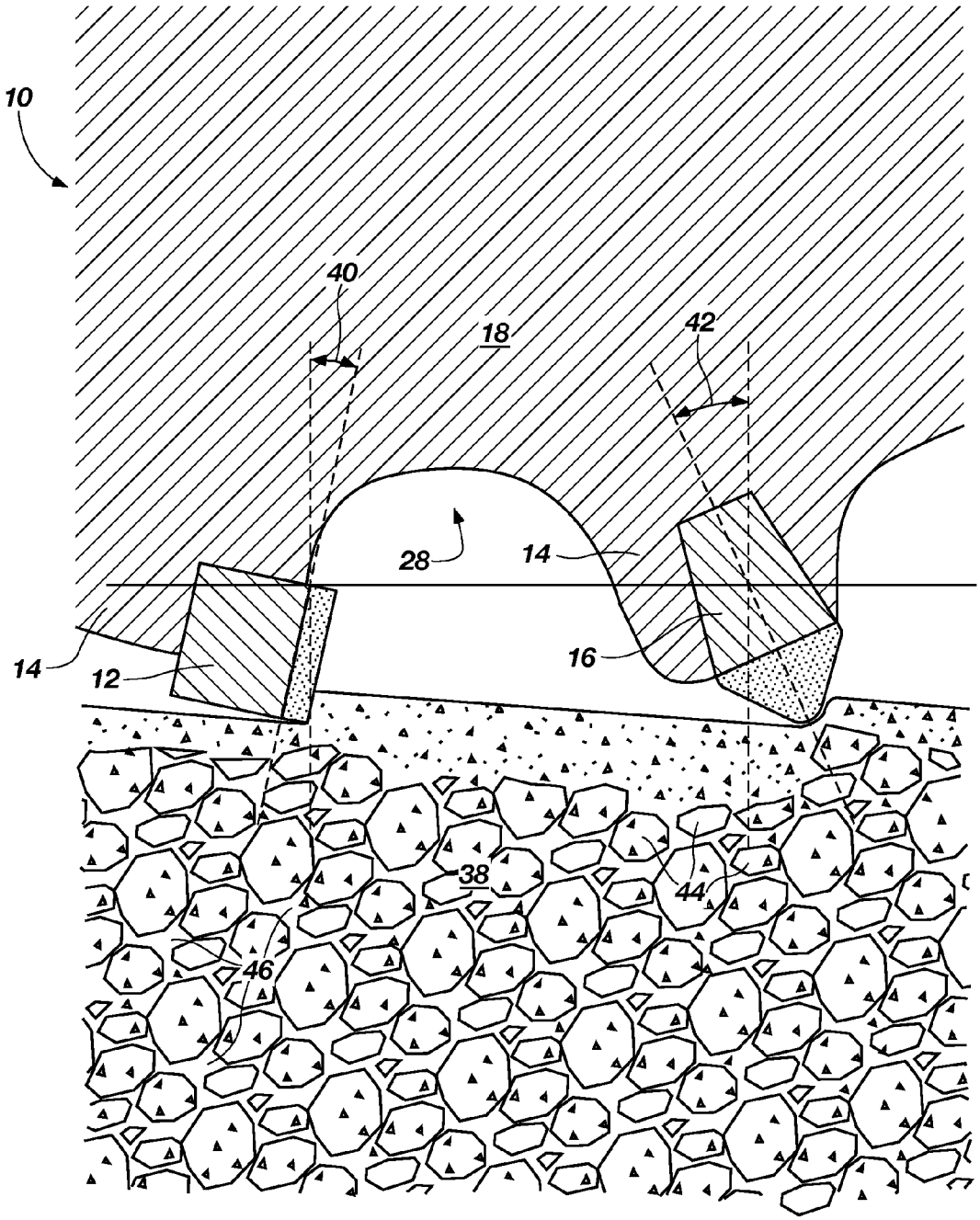
FIG. 13 depicts a simplified cross-sectional view of a gouging cutting element and a shearing cutting element engaging an underlying earth formation.

Referring to FIG. 13, a simplified cross-sectional view of a gouging cutting element 16 and a shearing cutting element 12 engaging an underlying earth formation 38 is shown. Shearing cutting elements 12 attached to blades 14 of earth-boring tools 10 may be oriented at negative back rake angles 40. Gouging cutting elements 16 attached to blades 14 of earth-boring tools 10 may be oriented at positive rake angles 42. As the earth-boring tool 10 rotates within the borehole, at least some of the shearing and gouging cutting elements 12 and 16 may engage the underlying earth formation 38 to facilitate its removal. For example, gouging cutting elements 16 may gouge and crush, which may be particularly effective to remove relatively harder portions, which may also be characterized as strata 44, of the earth formation 38. Shearing cutting elements 12, by contrast, may shear, which may be particularly effective to remove relatively softer portions 46 of the earth formation 38. In addition, gouging cutting elements 16 may damage the underlying earth formation 38, such as, for example, by crushing the hard portions thereof, creating a damaged zone that has a greater depth than a damaged zone created by shearing cutting elements 12, as shown in FIG. 13.

Figure 14:
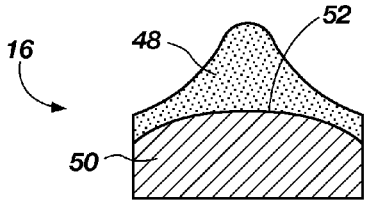
FIGS. 14 through 19 illustrate cross-sectional views of gouging cutting elements that may be attached to an earth-boring tool.
Figure 15:
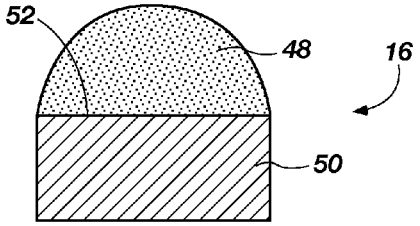
Figure 16:
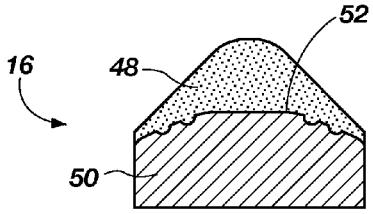
Figure 17:
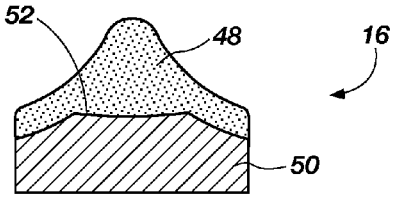
Figure 18:
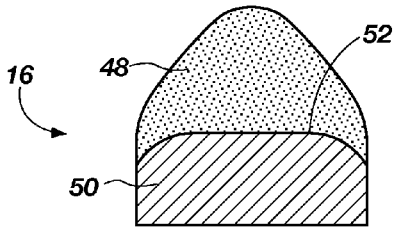

Referring to FIGS. 14 through 19, cross-sectional views of gouging cutting elements 16 that may be attached to an earth-boring tool, such as, for example, any of the earth-boring tools 10 and 10' shown in FIGS. 1 through 5 and 7 through 11, are shown. The gouging cutting elements 16 may comprise a polycrystalline superabrasive material 48 attached to an end of a substrate 50 at an interface 52. The polycrystalline superabrasive material 48 may comprise various shapes configured to gouge and crush an earth formation, such as, for example, chisel-shaped, dome-shaped, cone-shaped, and other shapes known in the art. The substrate 50 may comprise a shape configured to support the polycrystalline superabrasive material 48, such as, for example, cylindrical. The interface 52 between the polycrystalline superabrasive material 48 may be planar in some embodiments, as shown in FIG. 14, for example. In other embodiments, such as, for example, those shown in FIGS. 13 and 15 through 18, the interface 52 between the polycrystalline superabrasive material 48 may comprise a non-planar interface design, such as, for example, a series of protrusions and recesses, concentric rings, radially extending spokes, and other non-planar interface designs known in the art.

Figure 19:
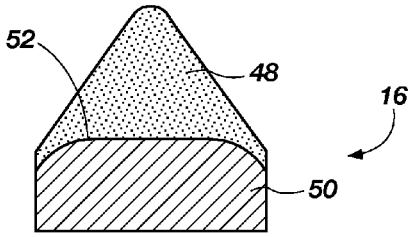
Figure 20:
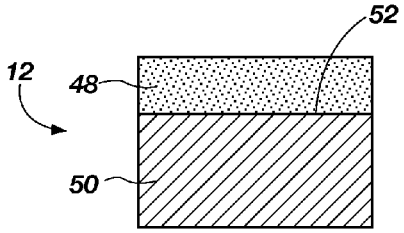
FIGS. 20 and 21 are cross-sectional views of shearing cutting elements that may be attached to an earth-boring tool.
Figure 21:
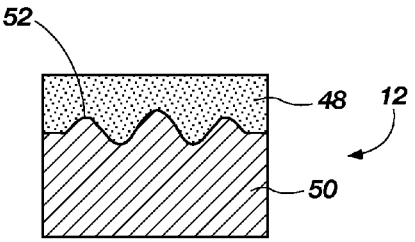

Referring to FIGS. 20 and 21, cross-sectional views of shearing cutting elements 12 that may be attached to an earth-boring tool, such as, for example, any of the earth-boring tools 10 and 10' shown in FIGS. 1 through 5 and 7 through 11, are shown. The shearing cutting elements 12 may comprise a polycrystalline superabrasive material 48 attached to an end of a substrate 50 at an interface 52. The polycrystalline superabrasive material 48 may comprise a shape configured to shear an earth formation, such as, for example, disc-shaped, cylindrical, and other shapes known in the art. The substrate 50 may comprise a shape configured to support the polycrystalline superabrasive material 48, such as, for example, cylindrical. The interface 52 between the polycrystalline superabrasive material 48 may be planar in some embodiments, as shown in FIG. 19, for example. In other embodiments, as shown in FIG. 20, for example, the interface 52 between the polycrystalline superabrasive material 48 may comprise a non-planar interface design, such as, for example, a series of protrusions and recesses, concentric rings, radially extending spokes, and other non-planar interface designs known in the art.

The polycrystalline superabrasive material 48 may comprise, for example, synthetic diamond, natural diamond, a combination of synthetic and natural diamond, cubic boron nitride, carbon nitrides, and other polycrystalline superabrasive materials known in the art. In some embodiments, catalyst material used in a process for forming the polycrystalline superabrasive material 48 (conventionally a high temperature/high pressure "HTHP" process) may be disposed in interstitial spaces among the interbonded grains of superabrasive material. In other embodiments, at least some of the catalyst material may be removed (e.g., leached using a leaching agent, such as, for example, aqua regia) from the interstitial spaces among the interbonded grains of superabrasive material of the polycrystalline superabrasive material 48.

One example of an HTHP process for forming the polycrystalline superabrasive material may comprise pressing a plurality of particles (e.g., grains or crystals) of the superabrasive material in a heated press at a pressure of greater than about 5.0 GPa and at temperatures greater than about 1,400° C., although the exact operating parameters of HTHP processes will vary depending on the particular compositions and quantities of the various materials being used. The pressures in the heated press may be greater than about 6.5 GPa (e.g., about 7 GPa), and may even exceed 8.0 GPa in some embodiments. Furthermore, the materials being sintered may be held at such temperatures and pressures for a time period between about 30 seconds and about 20 minutes.

The substrate 50 may comprise a hard material suitable for use in earth-boring applications. The hard material may comprise, for example, a ceramic-metal composite material (i.e., a "cermet" material) comprising a plurality of hard ceramic particles dispersed among a metal matrix material. The hard ceramic particles may comprise carbides, nitrides, oxides, and borides (including boron carbide ($B_4C$)). More specifically, the hard ceramic particles may comprise carbides and borides made from elements such as W, Ti, Mo, Nb, V, Hf, Ta, Cr, Zr, Al, and Si. By way of example and not limitation, materials that may be used to form hard ceramic particles include tungsten carbide, titanium carbide (TiC), tantalum carbide (TaC), titanium diboride ($TiB_2$), chromium carbides, titanium nitride (TiN), aluminum oxide ($Al_2O_3$), aluminum nitride (AlN), and silicon carbide (SiC). The metal matrix material of the ceramic-metal composite material may include, for example, cobalt-based, iron-based, nickel-based, iron- and nickel-based, cobalt- and nickel-based, and iron- and cobalt-based alloys. The matrix material may also be selected from commercially pure elements, such as, for example, cobalt, iron, and nickel. As a specific, non-limiting example, the hard material may comprise a plurality of tungsten carbide particles in a cobalt matrix, known in the art as cobalt-cemented tungsten carbide.

The bit body 18, including the blades 14 extending from the bit body 18, may comprise a material suitable for use in earth-boring applications. For example, the bit body 18 may comprise any of the hard materials described previously in connection with the substrate 50. Other materials are also contemplated, such as, for example, iron and steel. In some embodiments, particles of superabrasive material may be dispersed among and at least partially embedded within the bit body 18. In some embodiments, hardfacing may be applied to external surfaces of the earth-boring tool 10 or 10', such as for example, on the blades 14, within junk slots 30, and on the gage region 24.

The bit body 18 may be formed using conventional processes known in the art, such as, for example, machining, casting, and sintering. Likewise, shearing and gouging cutting elements 12 and 16 may be attached to the blades 14 of the earth-boring tool 10 or 10' by, for example, brazing, mechanical interference, and other attachment means known in the art.

While the present invention has been described herein with respect to certain embodiments, those of ordinary skill in the art will recognize and appreciate that it is not so limited. Rather, many additions, deletions, and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventor.

CONCLUSION

In some embodiments, earth-boring drill bits comprise a bit body having a plurality of radially extending blades and a plurality of cutting elements attached to the plurality of radially extending blades. Only gouging cutting elements are attached to at least one blade of the plurality of radially extending blades. Only shearing cutting elements are attached to at least another blade of the plurality of radially extending blades. Only shearing cutting elements are attached to a number of blades of the plurality of radially extending blades that is different from a number of blades of the plurality of radially extending blades to which only gouging cutting elements are attached.

In additional embodiments, methods of forming an earth-boring drill bit comprise forming a bit body including a plurality of radially extending blades. Only gouging cutting elements are attached to at least one blade of the plurality of radially extending blades. Only shearing cutting elements are attached to at least another blade of the plurality of radially extending blades. Only shearing cutting elements are attached to a number of blades different from a number of blades to which only gouging cutting elements are attached.

What is claimed is:

1. An earth-boring drill bit, comprising:

a bit body comprising blades extending radially over a face of the earth-boring drill bit and cutting elements attached to each blade, wherein:

only cutting elements comprising planar cutting faces are attached to at least one of the blades;

only cutting elements comprising nonplanar cutting faces are attached to at least another of the blades;

only cutting elements comprising planar cutting faces or only cutting elements comprising nonplanar cutting faces are attached to each of the blades; and only cutting elements comprising nonplanar cutting faces are attached to a number of the blades that is unequal to a number of the blades to which only cutting elements comprising planar cutting faces are attached.

2. The earth-boring drill bit of claim 1, wherein the number of the blades to which only cutting elements comprising planar cutting faces are attached is greater than the number of the blades to which only cutting elements comprising nonplanar cutting faces are attached.

3. The earth-boring drill bit of claim 2, wherein at least one blade to which only cutting elements comprising nonplanar cutting faces are attached is located at an angular position rotationally closer to an immediately rotationally leading blade to which only cutting elements comprising planar cutting faces are attached than if all the blades were spaced exactly equally apart.

4. The earth-boring drill bit of claim 2, wherein only cutting elements comprising nonplanar cutting faces are attached to only one of the blades.

5. The earth-boring drill bit of claim 2, wherein only cutting elements comprising nonplanar cutting faces are attached to at least two of the blades.

6. The earth-boring drill bit of claim 5, wherein the at least two of the blades are located about 180° from one another.

7. The earth-boring drill bit of claim 1, wherein the number of the blades to which only cutting elements comprising nonplanar cutting faces are attached is greater than the number of the blades to which only cutting elements comprising planar cutting faces are attached.

8. The earth-boring drill bit of claim 7, wherein only cutting elements comprising planar cutting faces are attached to only one of the blades.

9. The earth-boring drill bit of claim 7, wherein only cutting elements comprising planar cutting faces are attached to at least two of the blades.

10. The earth-boring drill bit of claim 9, wherein the at least two of the blades are located about 180° from one another.

11. The earth-boring drill bit of claim 7, wherein at least one of the blades to which only cutting elements comprising nonplanar cutting faces are attached extends from the bit body in a direction that forms an oblique angle with a line tangent at a point of intersection of a central axis of the at least one of the blades with a radially outer surface of the bit body from which the at least one of the blades protrudes.

12. The earth-boring drill bit of claim 1, wherein the cutting elements comprising nonplanar cutting faces comprise a polycrystalline superabrasive material defining the cutting face that is at least one of dome-shaped, chisel-shaped, and cone-shaped.

13. The earth-boring drill bit of claim 1, wherein the cutting elements comprising planar cutting faces comprise a polycrystalline superabrasive material that is disc-shaped to define planar cutting faces.

14. The earth-boring drill bit of claim 1, wherein a rotationally leading cutting element comprising nonplanar cutting faces of the at least one of the blades is positioned to travel in a helical path at least partially overlapping with a helical path in which a rotationally trailing cutting element comprising planar cutting faces of the at least another of the blades is positioned to travel.

15. The earth-boring drill bit of claim 1, wherein a total number of the blades is six or fewer.

16. A method of forming an earth-boring drill bit, comprising:

forming a bit body comprising blades extending radially over a face of the earth-boring drill bit;

attaching only cutting elements comprising nonplanar cutting faces to at least one of the blades;

attaching only cutting elements comprising planar cutting faces to at least another of the blades;

attaching only cutting elements comprising nonplanar cutting faces or only cutting elements comprising planar cutting faces to each of the blades; and attaching only cutting elements comprising nonplanar cutting faces to a number of blades different from a number of blades to which only cutting elements comprising planar cutting faces are attached.

17. The method of claim 16, wherein attaching only cutting elements comprising nonplanar cutting faces to at least one of the blades comprises attaching only cutting elements comprising nonplanar cutting faces to at least two of the blades.

18. The method of claim 17, further comprising:

positioning the at least two of the blades at angular positions that are spaced about 180° from one another.

19. The method of claim 17, further comprising:

positioning a rotationally leading cutting element comprising a nonplanar cutting face of the at least one of the blades to travel in a helical path at least partially overlapping with a helical path in which a rotationally trailing cutting element comprising a planar cutting face of the at least another of the blades is positioned to travel.

20. The method of claim 16, further comprising:

forming at least one of the cutting elements using an HTHP process comprising subjecting a plurality of particles comprising a superabrasive material to a pressure of at least 7.0 GPa and a temperature of at least 1,400° C. for between 30 sec. and 20 min.

* * * * *